US009506242B2

(12) United States Patent
Mei

(10) Patent No.: US 9,506,242 B2
(45) Date of Patent: Nov. 29, 2016

(54) STRUCTURAL ENGINEERED WOOD RIM BOARD CORNER SYSTEM AND METHOD FOR LIGHT FRAME CONSTRUCTION

(71) Applicant: Edmund Mei, Saddle River, NJ (US)

(72) Inventor: Edmund Mei, Saddle River, NJ (US)

( * ) Notice: Subject to any disclaimer, the term of this patent is extended or adjusted under 35 U.S.C. 154(b) by 0 days.

(21) Appl. No.: 15/010,422

(22) Filed: Jan. 29, 2016

(65) Prior Publication Data

US 2016/0145855 A1 May 26, 2016

Related U.S. Application Data

(63) Continuation of application No. 14/451,813, filed on Aug. 5, 2014, now Pat. No. 9,249,574.

(60) Provisional application No. 61/863,283, filed on Aug. 7, 2013.

(51) Int. Cl.

| | |
|---|---|
| ***E04B 1/26*** | (2006.01) |
| ***E04C 3/14*** | (2006.01) |
| ***E04C 3/18*** | (2006.01) |
| ***E04B 1/58*** | (2006.01) |
| ***E04B 5/12*** | (2006.01) |
| ***E04C 3/02*** | (2006.01) |

(52) U.S. Cl.

CPC . *E04B 1/58* (2013.01); *E04B 1/26* (2013.01); *E04B 1/2608* (2013.01); *E04B 5/12* (2013.01); *E04C 3/02* (2013.01); *E04C 3/14* (2013.01); *E04C 3/18* (2013.01); *E04C 3/185* (2013.01); *E04B 2001/2616* (2013.01); *E04B 2001/2644* (2013.01); *E04C 2003/023* (2013.01)

(58) Field of Classification Search

CPC ..... E04B 1/2604; E04B 1/2608; E04B 2001/2616; E04B 2001/2644; E04B 2001/2648; E04B 5/12; E04C 3/14; E04C 3/18

See application file for complete search history.

(56) References Cited

U.S. PATENT DOCUMENTS

| | | | | |
|---|---|---|---|---|
| 1,377,891 A * | 5/1921 | Knight | E04C 3/122 | 52/841 |
| 1,423,468 A * | 7/1922 | Stadelman | E04B 1/26 | 52/280 |
| 3,960,637 A | 6/1976 | Ostrow | | |
| 3,964,218 A | 6/1976 | Ho | | |
| 4,191,000 A | 3/1980 | Henderson | | |
| 4,195,462 A | 4/1980 | Keller et al. | | |
| 4,283,900 A * | 8/1981 | Schubert | E04B 1/2604 | 403/402 |

(Continued)

FOREIGN PATENT DOCUMENTS

| | | | |
|---|---|---|---|
| CA | 2360728 A1 * | 4/2003 | E04C 3/14 |

OTHER PUBLICATIONS

Baczek et al., "Advanced Framing: Using Wood Efficiently from Optimizing Design to Minimizing the Dumpster", Research Report-0201, BuildingScience (www.buildingscience.com) (Aug. 2002).

(Continued)

*Primary Examiner* — Ryan Kwiecinski

(74) *Attorney, Agent, or Firm* — Weitzman Law Offices, LLC

(57) ABSTRACT

A structural engineered wood rim board corner system for light frame construction involves two intersecting structural engineered wood rim boards each having a cavity on an exterior angle side of the intersection and an auxiliary corner support having two arms, each within a respective one of the cavities, is disclosed. A corresponding light frame construction corner forming method is also disclosed.

15 Claims, 21 Drawing Sheets

(56) References Cited

U.S. PATENT DOCUMENTS 4,584,809 A 4/1986 Stanford
4,637,194 A 1/1987 Knowles
4,638,619 A 1/1987 Fischetti
4,682,458 A 7/1987 Sparrow
4,716,695 A 1/1988 Alexander et al.
4,967,534 A 11/1990 Lines
5,848,513 A * 12/1998 Leslie ..... E04B 1/34321 52/264
6,012,262 A 1/2000 Irving
6,212,846 B1 4/2001 Johnston
6,301,854 B1 10/2001 Daudet et al.
6,318,046 B1 * 11/2001 Horsfield ..... E04C 3/14 52/847
6,460,310 B1 10/2002 Ford et al.
6,901,715 B2 6/2005 Brown et al.
7,124,544 B2 10/2006 Brown et al.
7,451,575 B2 11/2008 Hall et al.
7,765,771 B2 8/2010 Serpico et al.
7,827,763 B2 11/2010 Brown et al.
7,832,179 B2 11/2010 Ou
7,856,786 B2 12/2010 Beck et al.
8,061,108 B2 11/2011 Tonyan et al.
8,091,316 B2 1/2012 Beck et al.
8,281,540 B2 10/2012 Strickland et al.
8,322,037 B2 12/2012 Carlson et al.
8,756,871 B1 * 6/2014 Johnson ..... E02D 31/02 52/2.14
8,910,455 B2 * 12/2014 Yang ..... E04C 3/292 29/428
2002/0112438 A1 * 8/2002 Little ..... E04B 1/2608 52/702
2002/0121066 A1 * 9/2002 Callahan ..... E04B 5/12 52/713
2002/0152706 A1 10/2002 Smith
2002/0152712 A1 10/2002 Smith
2003/0159367 A1 8/2003 Brown et al.
2003/0159396 A1 * 8/2003 Brown ..... E04B 5/12 52/702
2005/0210827 A1 9/2005 Schwartz
2006/0016139 A1 * 1/2006 Beck ..... E04B 1/24 52/289
2006/0254192 A1 * 11/2006 Fennell, Jr. ..... E04B 7/02 52/699
2007/0119108 A1 5/2007 Downard
2007/0193199 A1 8/2007 Carlson et al.
2008/0271405 A1 * 11/2008 Masters ..... E04B 1/2604 52/655.1
2008/0302037 A1 12/2008 Brown et al.
2009/0064611 A1 3/2009 Hall et al.
2010/0037547 A1 2/2010 Taraba et al.
2010/0037551 A1 2/2010 Bodnar
2010/0239387 A1 * 9/2010 Gray ..... E04B 1/2608 411/411
2011/0067346 A1 * 3/2011 Chalker ..... E04B 1/26 52/702
2011/0078967 A1 4/2011 Pacylowski
2011/0146173 A1 * 6/2011 Visser ..... E04B 1/26 52/268
2011/0154746 A1 * 6/2011 Hill ..... E04B 1/26 52/105
2012/0085049 A1 * 4/2012 Schiffmann ..... E04B 1/0007 52/293.1
2012/0298943 A1 * 11/2012 Yang ..... E04B 1/30 256/13.1
2013/0000223 A1 * 1/2013 Hill ..... E04B 1/26 52/105
2013/0167473 A1 7/2013 Creel et al.
2013/0340359 A1 * 12/2013 Lichtenfeld ..... E04H 9/027 52/167.1
2014/0215956 A1 * 8/2014 Smith ..... E04B 1/003 52/705
2015/0052845 A1 * 2/2015 Desautels ..... E04C 3/36 52/650.3
2015/0135638 A1 * 5/2015 Yang ..... E04C 3/46 52/841

OTHER PUBLICATIONS

The Engineered Wood Associate, "APA Performance Rates I-Joists", Form No. EWS Z725K (2004).
Lstiburek, "The Future of Framing is Here", Fine Homebuilding, pp. 50-55 (Oct./Nov. 2005).
The Engineered Wood Association, "APA Performance Rated Rim Boards®", Form No. W345K (2009).
Georgia Pacific, "Engineered Lumber, Edition IX, Residential Floor & Roof Systems Product Guide" (Jan. 2010).
Lstiburek, "Insight Advanced Framing", BuildingScience BSI-00 (www.buildingsciencecom), (Feb. 2010).
Marinoware, "JoistRite® Technical Guide"(2011).
ANSI/APA, "Standard for Performance-Rated Engineered Wood Rim Boards", PRR 410-2011 (Dec. 2011).
Pinkwood, PKJoists (web page) (2012).
Anthony Eacom Inc., Power Joist® United States User Guide ICC ESR-1262 (2012).
ICC Evaluation Service LLC, "Evaluation Report—Performance Rated I-Joists", ESR-1405 (Nov. 2013).
Anthony Eacom Inc., PowerJoist® United States Installation Guide ICC ESR-1262 (Feb. 2014).

* cited by examiner

STRUCTURAL ENGINEERED WOOD RIM BOARD CORNER SYSTEM AND METHOD FOR LIGHT FRAME CONSTRUCTION

CROSS REFERENCE TO RELATED APPLICATION

This application claims the priority benefit of U.S. Provisional Patent Application No. 61/863,283, filed Aug. 7, 2013, and is a continuation of U.S. patent application Ser. No. 14/451,813, filed Aug. 5, 2014, the entirety of both are incorporated herein by reference in their entirety.

I. BACKGROUND a) Field of the Invention

This disclosure relates generally to engineered wood building materials and, more particularly, to engineered wood rim boards used in light frame construction of buildings.

b) Background

From the 1960s to the present the wood framing industry has evolved where more and more dimensional framing members are being replaced by their engineered lumber counterparts. Engineered Lumber Manufactures have developed a multitude of innovative engineered lumber framing members that improve upon their dimensional lumber predecessors in order to meet the needs required by today's building industry.

Engineered lumber use various types of structural composite lumber such as laminated veneer lumber ("LVL"), parallel strand lumber ("PSL"), laminated strand lumber ("LSL"), oriented strand lumber ("OSL"), glue laminated timber ("gluelam") to create structural components, such as rim boards and I-joists, designed to meet a corresponding variety of specific structural framing requirements.

Conventional rim board or rim joists used in constructing floor platforms may not be able to carry the structural load above wall openings such as doors and windows by themselves, particularly as the opening width is increased, requiring the use of structural headers.

Likewise, conventional double plates in the top floor of a structure to support ceiling joists and roof rafters may similarly not be able to carry the structural load of the roof, particularly above wall openings such as doors and windows in the top floor.

Moreover, for multi-story light frame construction, the loads that must be carried by the rim boards of lower floors increases as new floors are added during construction.

In the above cases, additional structural elements, such as extra king studs, jamb/jack studs, cripples, structural headers, etc. are used to augment the load-carrying capability over openings and/or for supporting ceiling joists and roof rafters. However, those additional elements add cost and waste. In an effort to reduce cost and waste in light frame construction, techniques known as "advanced framing techniques" have been devised. Advanced framing techniques use a systems approach to the design, engineering, and construction of wood-framed structures to reduce lumber use, minimize wood waste, and maximize a structure's thermal efficiency, while still maintaining the structural integrity and meeting building codes.

II. SUMMARY

I have devised a structural engineered wood rim board for light frame construction that provides improved load carrying capability and is readily usable with advanced framing techniques or to simplify framing.

One aspect involves a structural engineered wood rim board corner system for light frame construction. The system includes two structural engineered wood rim boards. Each of the two structural engineered wood rim boards is made up of a pair of flanges connected by a web so as to form a recessed cavity in-between the flanges on one side and on an opposite side of the structural engineered wood rim boards the pair of flanges and web form a surface that is substantially flat. The width of the web of each of the two structural engineered wood rim boards is at least 50% of the overall width of the structural engineered wood rim boards. The two engineered wood rim boards are abutted relative to each other at corresponding ends so as to form an angled intersection, with the cavity being on an exterior angle portion of the intersection.

The system also includes an auxiliary corner support made up of two arms oriented at an angle relative to each other corresponding to the angled intersection. The auxiliary corner support has a width substantially equal to the width of the web. One of the two arms of the auxiliary corner support is within one of the cavities and the other of the two arms is within the other cavity. Each of the two arms abut and are affixed to their corresponding webs, so as to concurrently (1) maintain the two engineered wood rim boards at an orientation relative to each other corresponding to the angle, and (2) assist the web in transferring a load applied to the upper flanges near the corner to a part of the structure below the lower flanges while resisting spreading of the corresponding ends of the two engineered wood rim boards at the angled intersection.

Another aspect involves a method performed as part of light frame construction. The method involves abutting two structural engineered wood rim boards relative to each other at corresponding ends at an angle of intersection so as to form a corner for the light frame construction, wherein i) each of the two structural engineered wood rim boards is made up of a pair of flanges connected by a web so as to form a recessed cavity in-between the flanges on one side and, on an opposite side of the structural engineered wood rim boards, ii) the pair of flanges and web form a surface that is substantially flat, iii) the width of the web of each of the two structural engineered wood rim boards is at least 50% of the overall width of the structural engineered wood rim boards, and iv) the recessed cavity is on an exterior angle portion of the intersection.

The method also involves attaching an auxiliary corner support, having two arms, to the two structural engineered wood rim boards, wherein i) the auxiliary corner support has a width substantially equal to the width of the web, ii) one of the two arms of the auxiliary corner support is within one of the cavities and the other of the two arms of the auxiliary corner support is within the other cavity, and iii) each of the two arms abut and are affixed to their corresponding webs.

In combination, the two structural engineered wood rim boards and the auxiliary corner support are involved in i) maintaining the two engineered wood rim boards at an orientation relative to each other corresponding to the angle, ii) assisting the respective webs in transferring a load, applied to at least an upper flange of at least one of the two structural engineered wood rim boards near the corner, to a part of the light frame construction below the combination, and iii) resisting spreading of the corresponding ends of the two engineered wood rim boards at the corner.

The foregoing has outlined rather generally the features and technical advantages of one or more embodiments of this disclosure in order that the following detailed description may be better understood. Additional features and advantages of this disclosure will be described hereinafter, which may form the subject of the claims of this application.

III. BRIEF DESCRIPTION OF THE DRAWINGS

Figure 3:
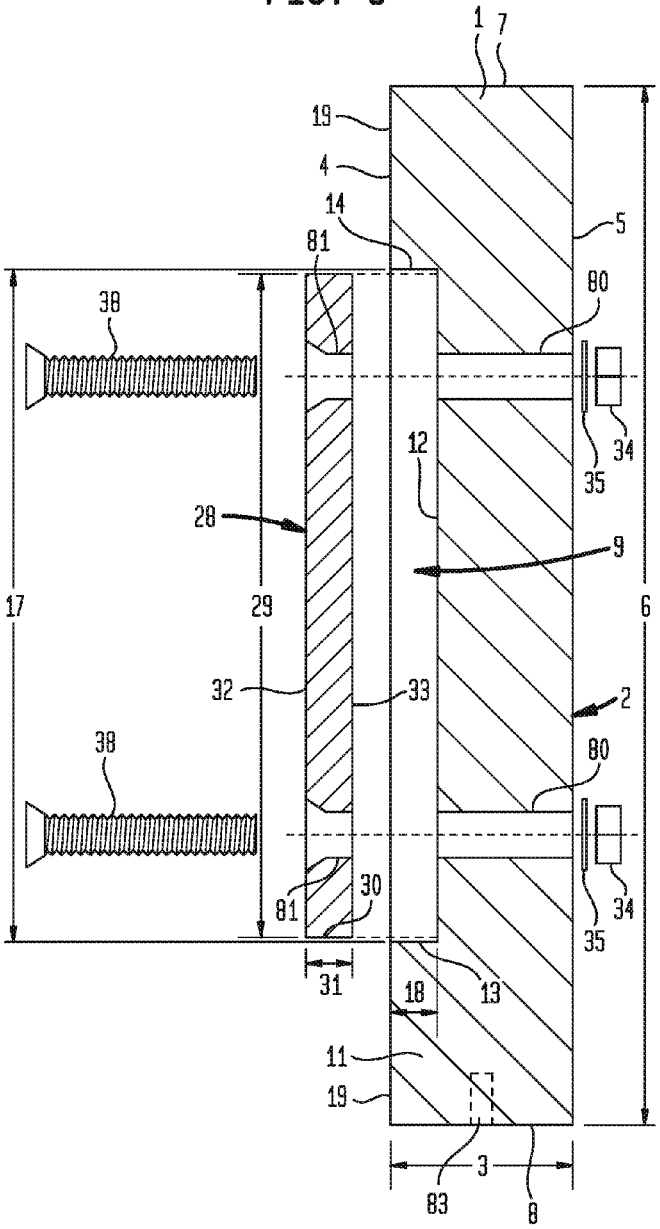
Figure 4:
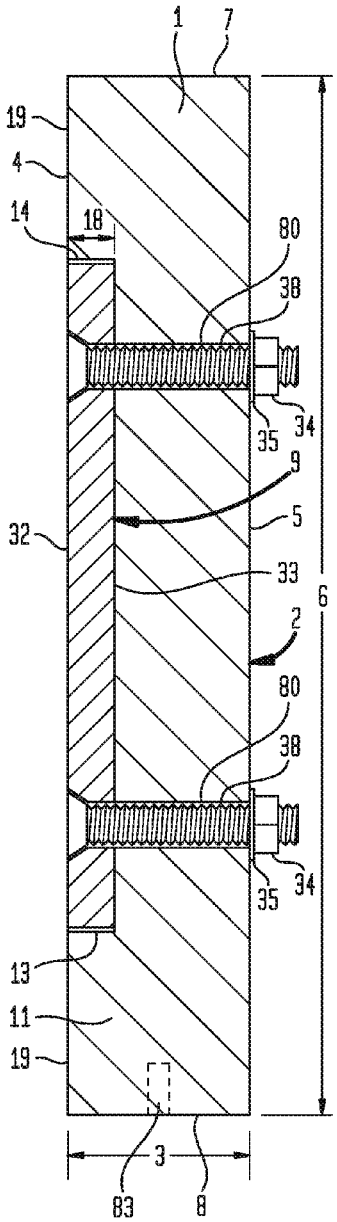
Figure 5:
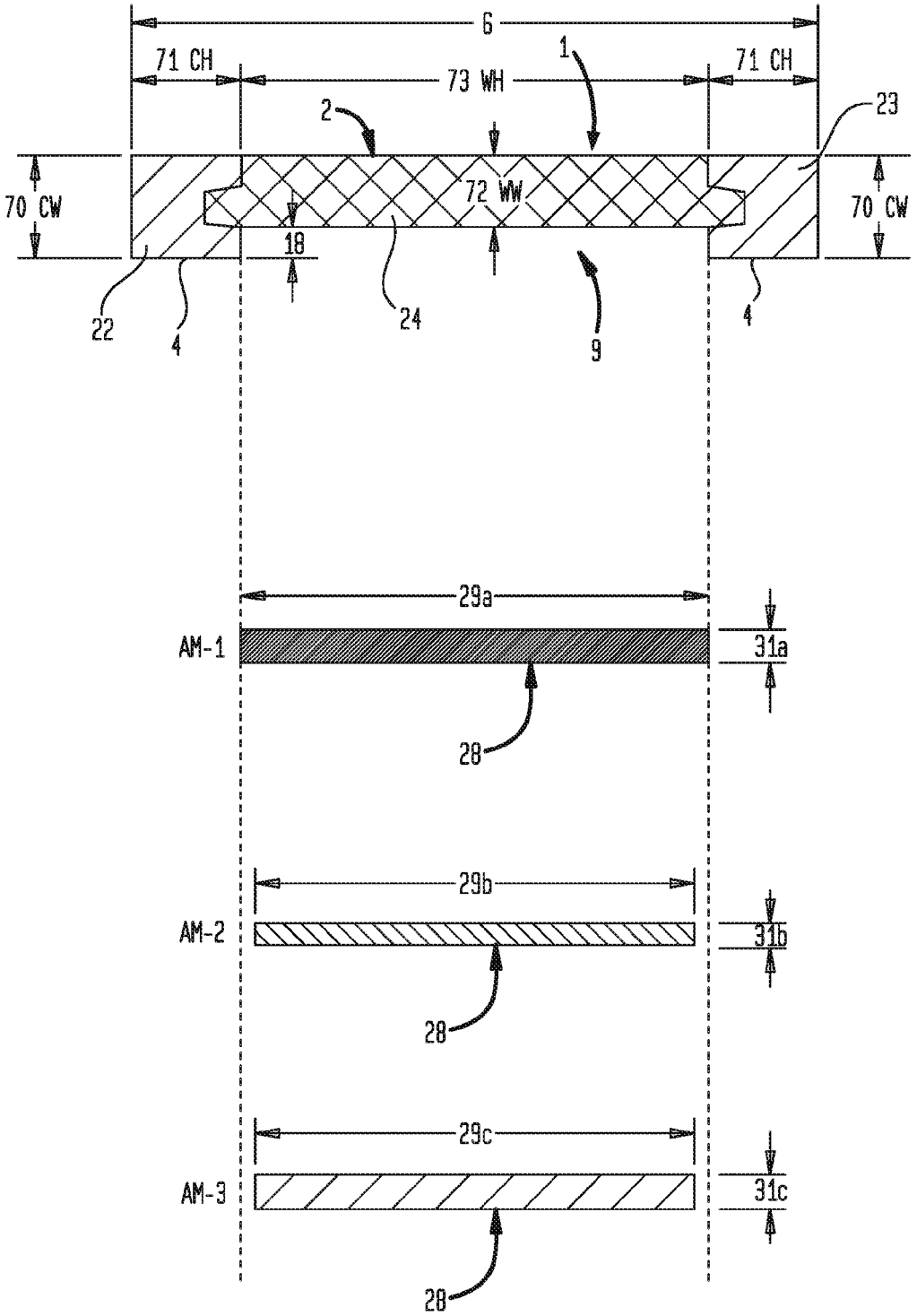
Figure 6A:
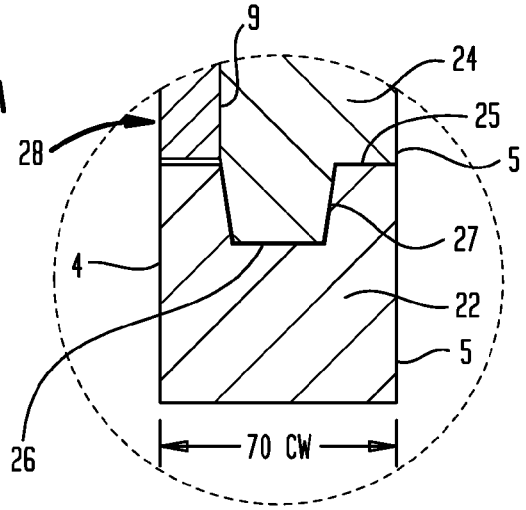
Figure 6B:
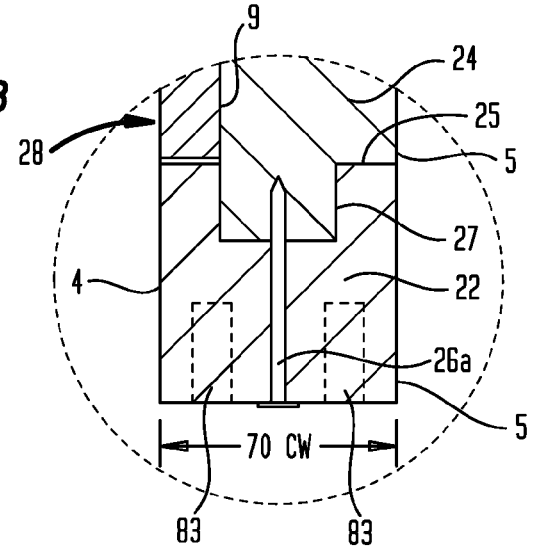
Figure 6C:
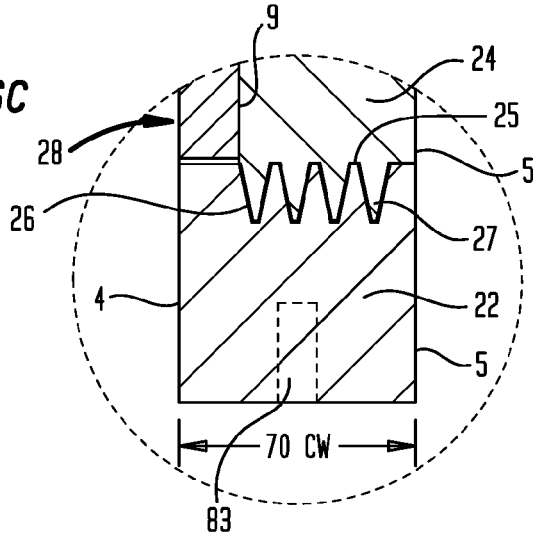
Figure 8:
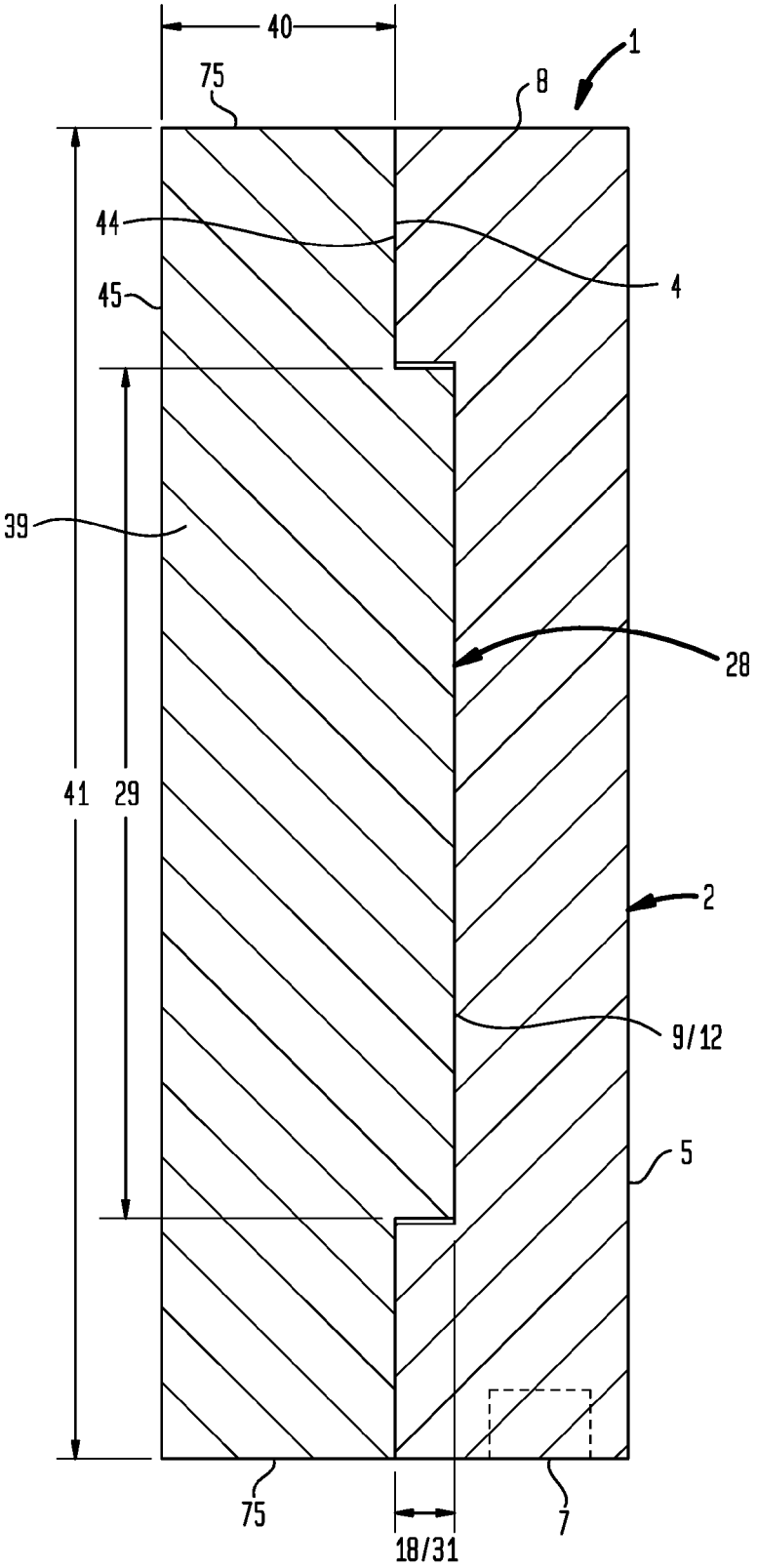
Figure 9:
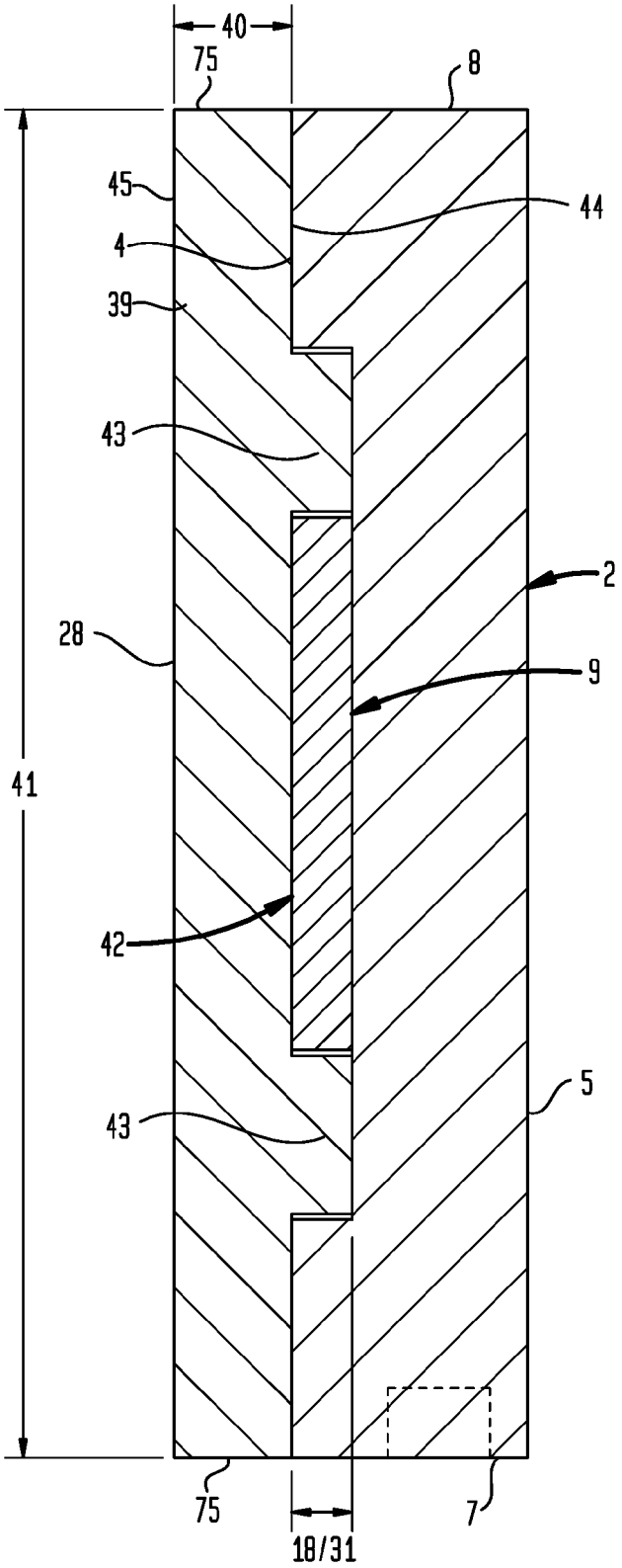
Figure 10:
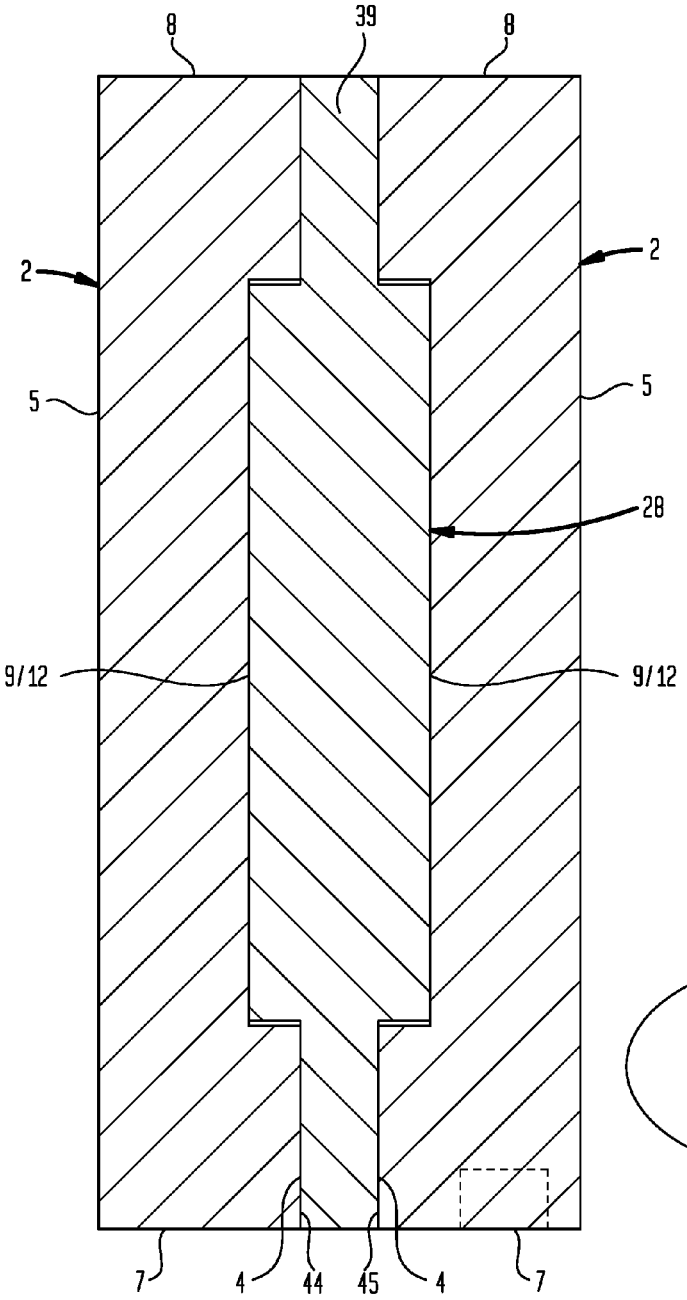
Figure 11:
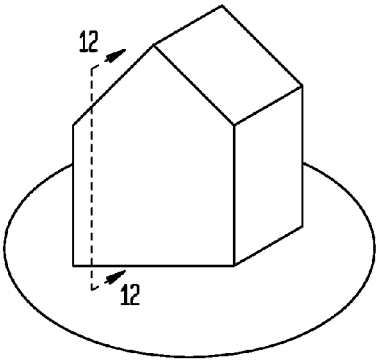
Figure 12A:
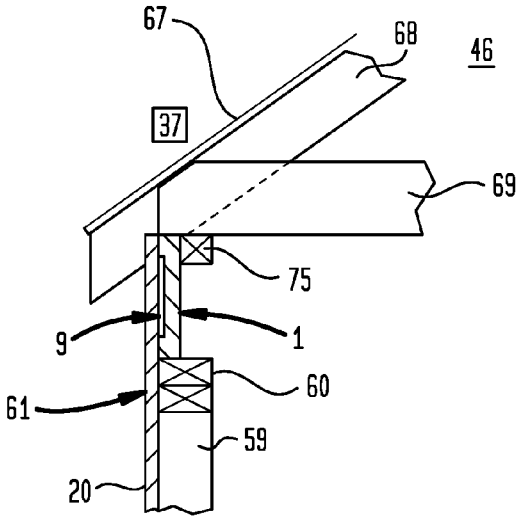
Figure 12B:
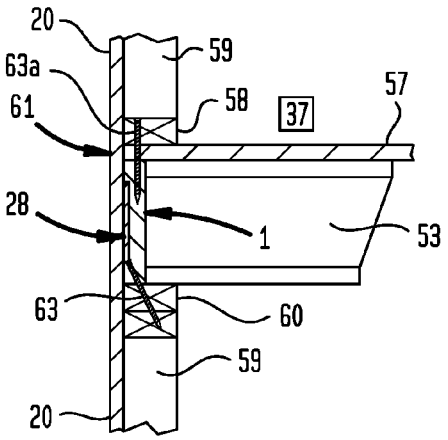
Figure 13:
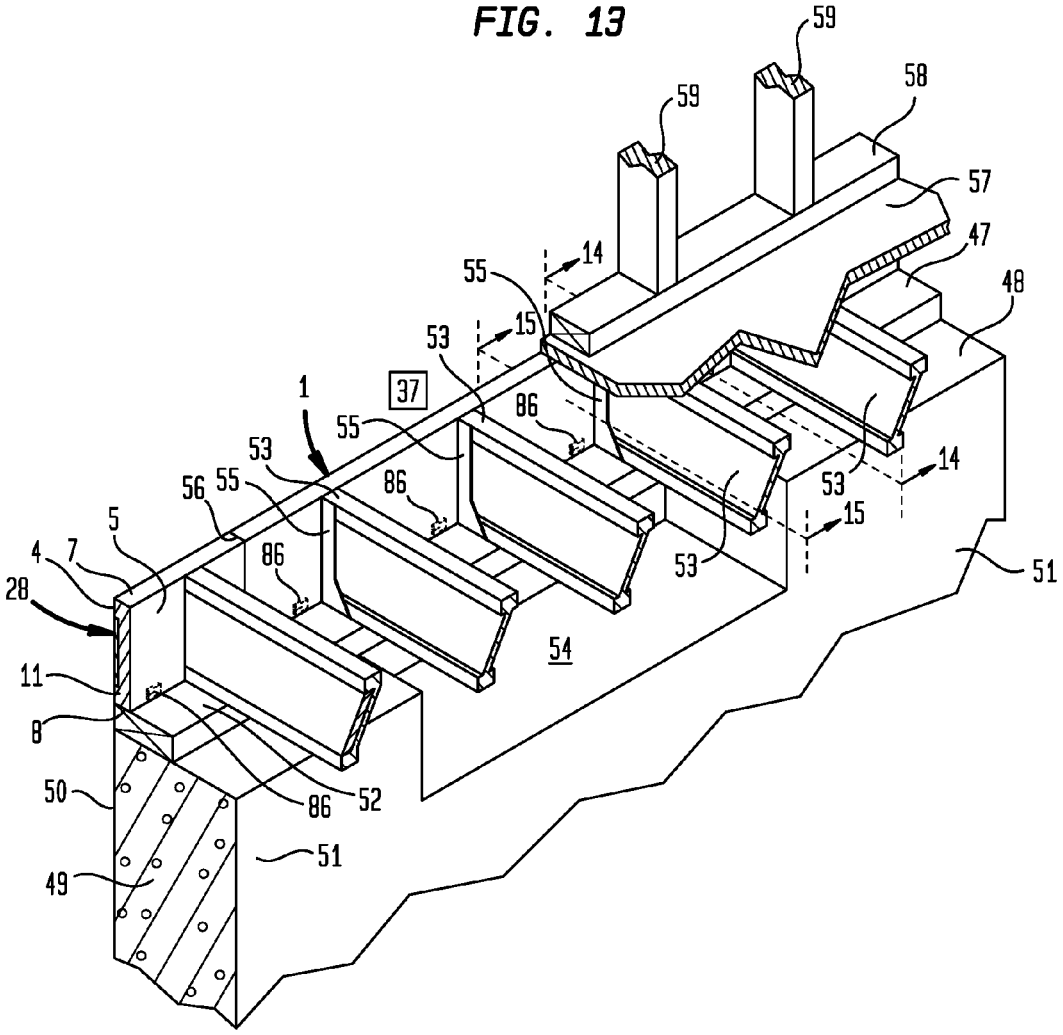
Figure 14:
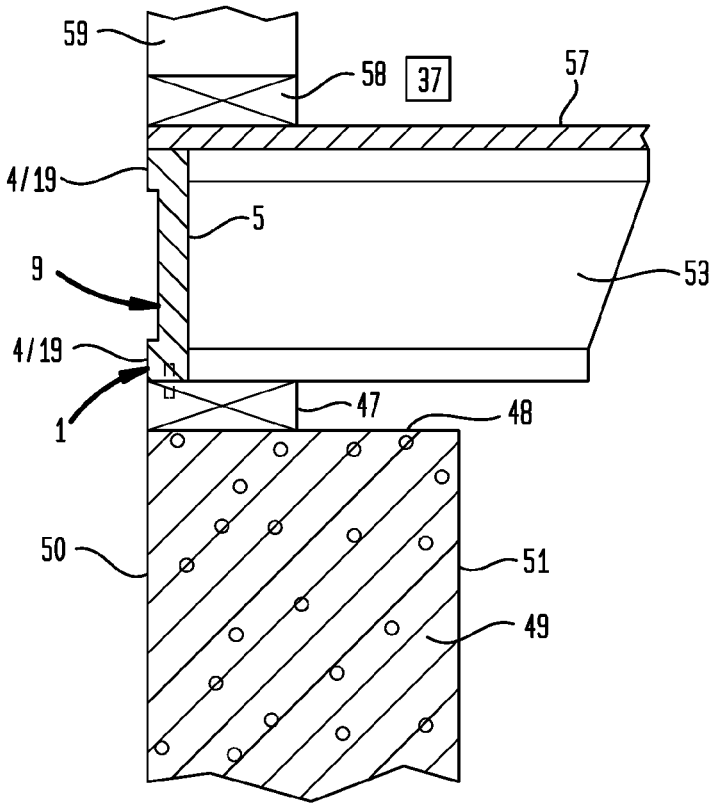
Figure 15:
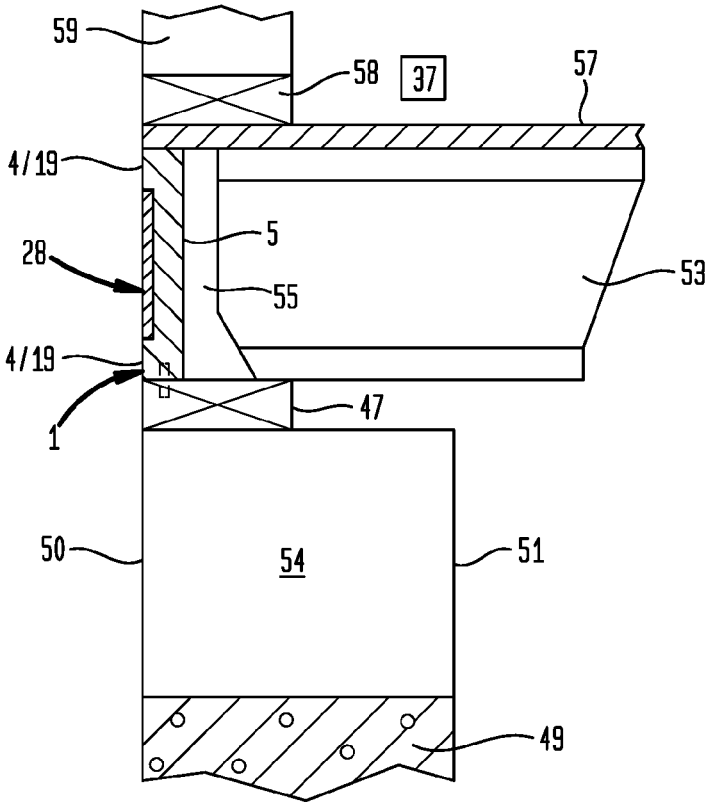
Figure 16:
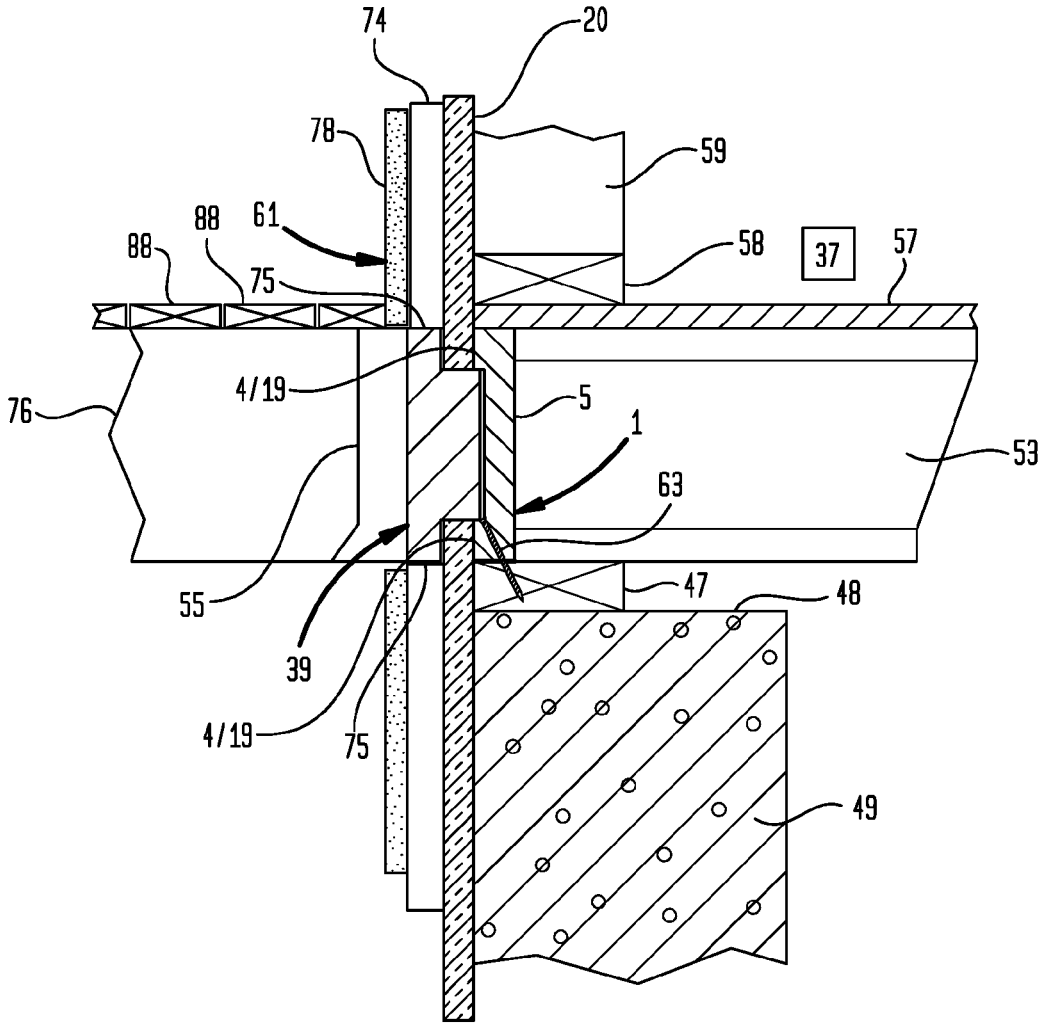
Figure 17:
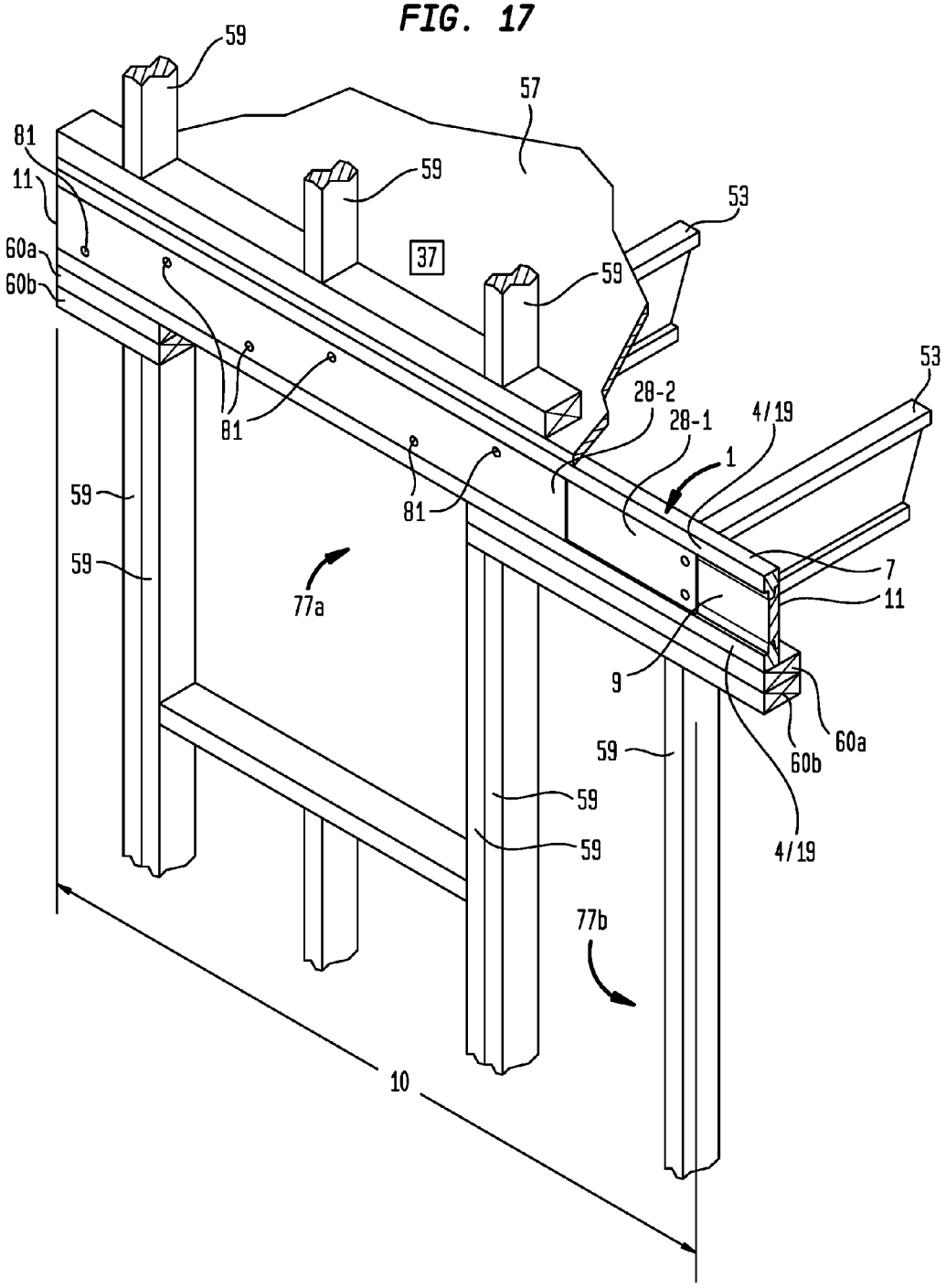
Figure 18:
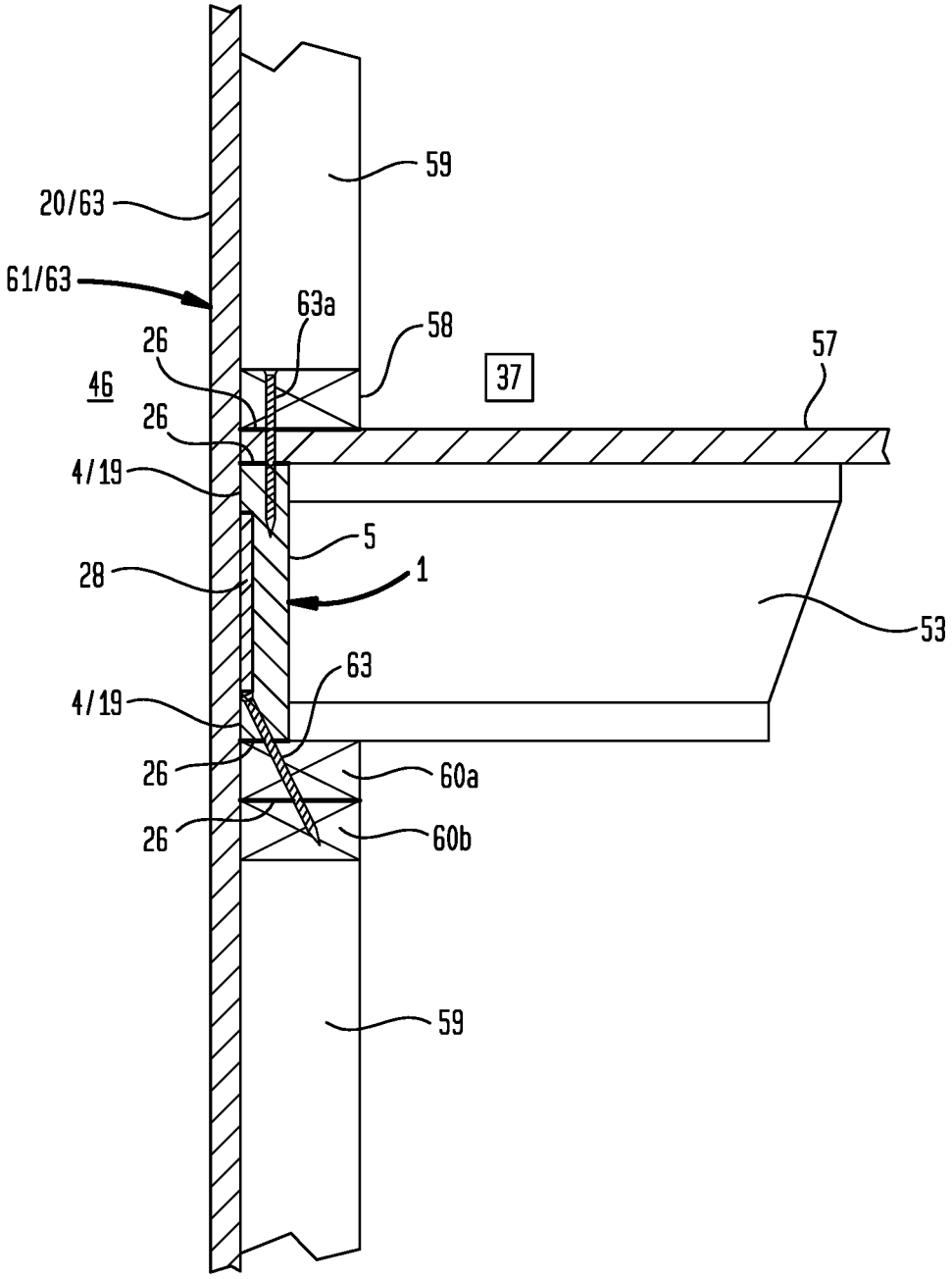
Figure 19:
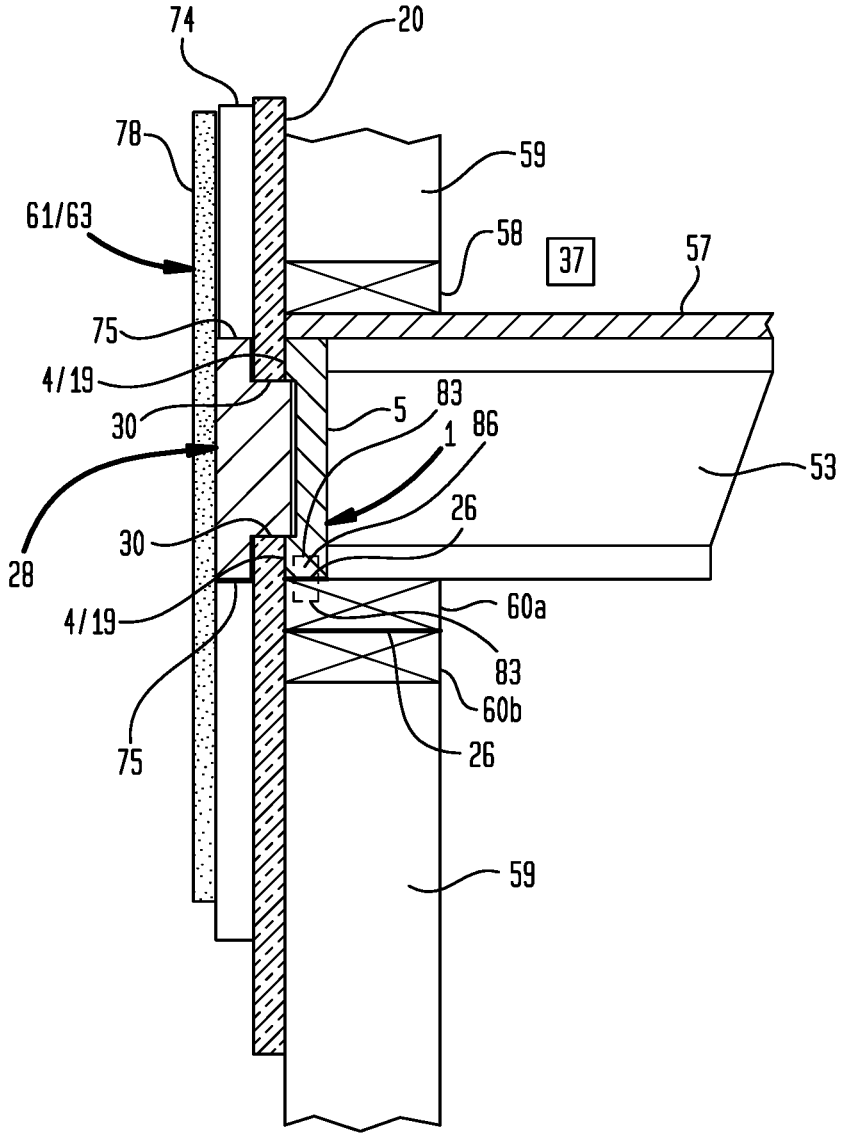
Figure 20:
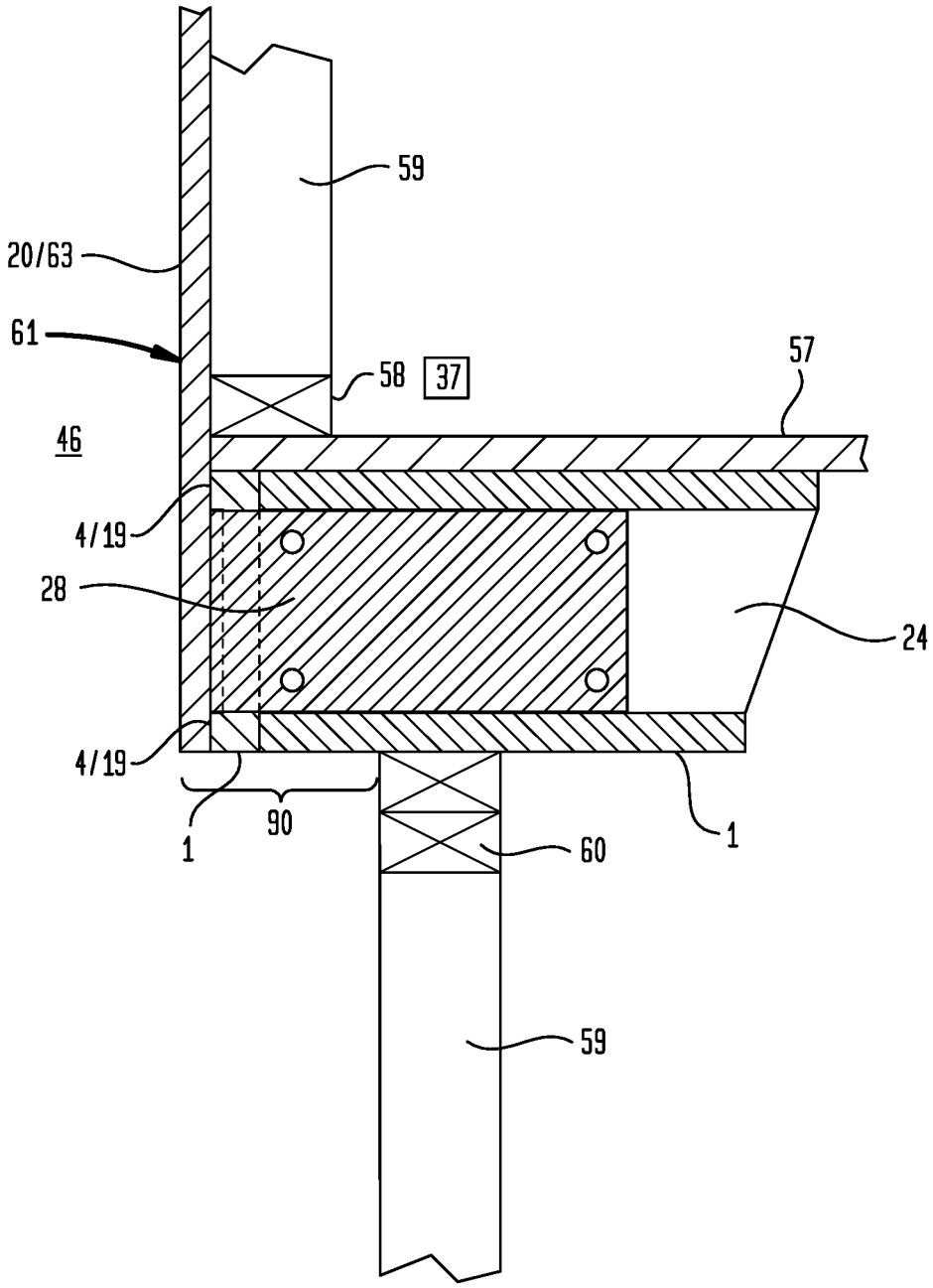
Figure 21:
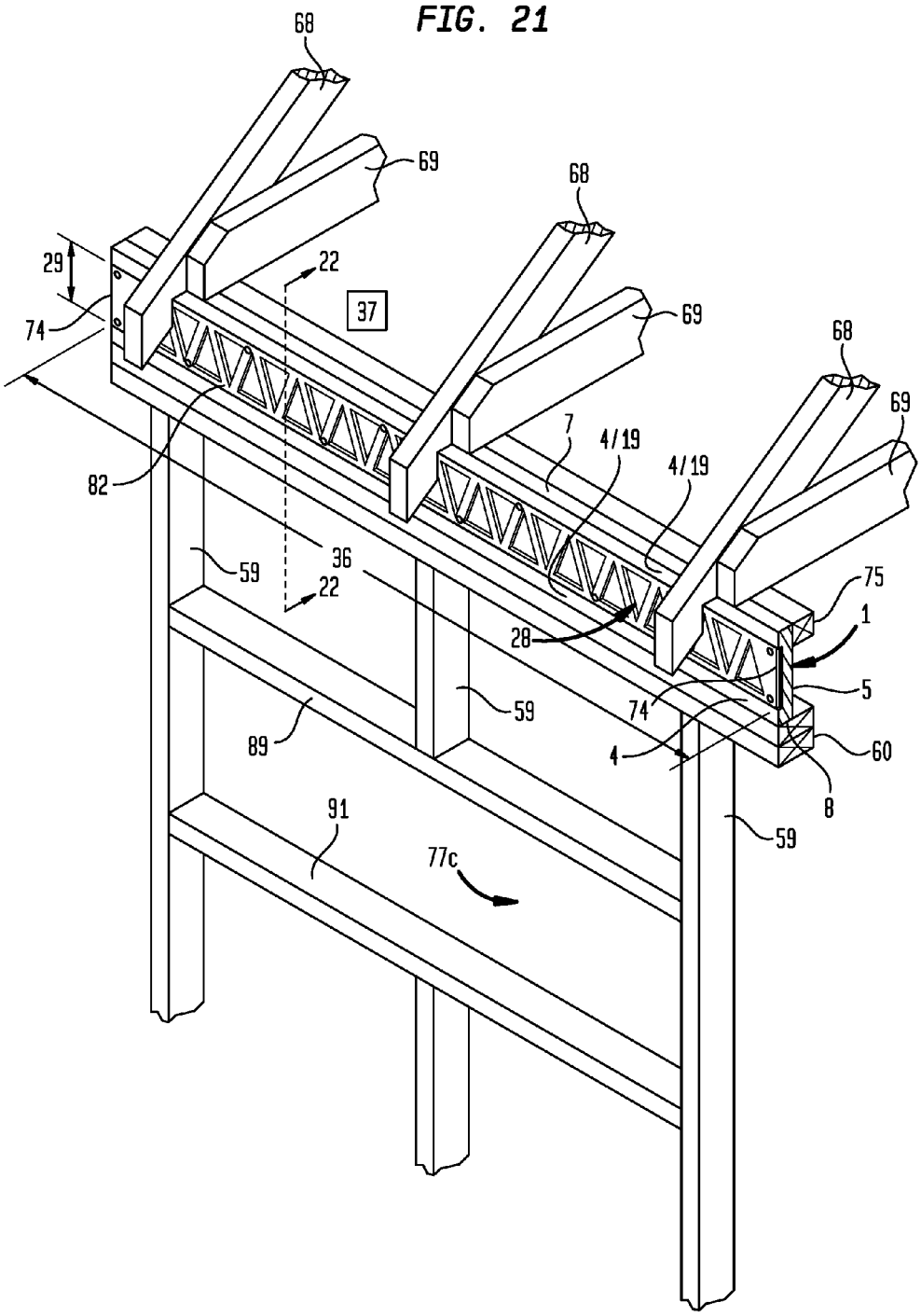
Figure 22:
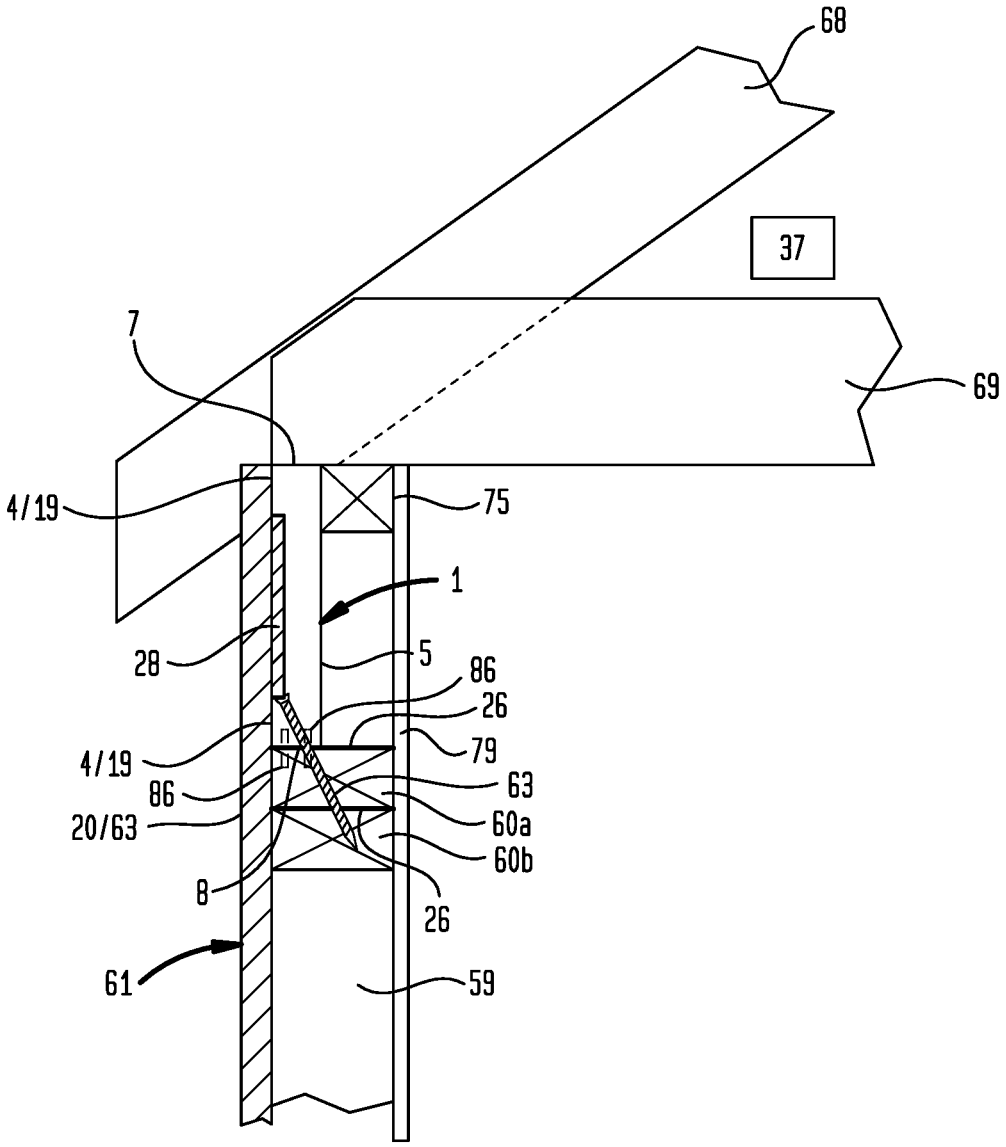
Figure 23:
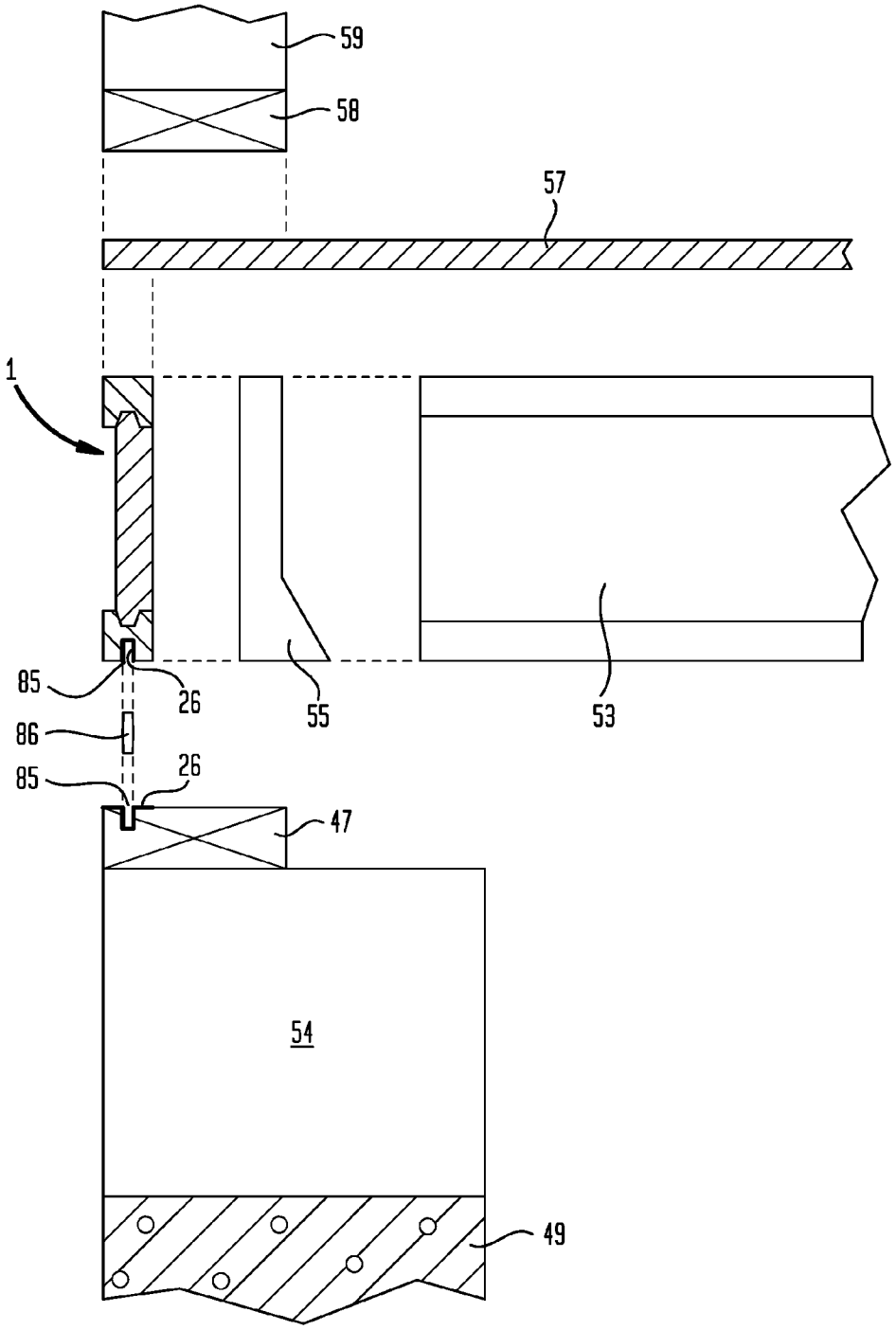
Figure 24:
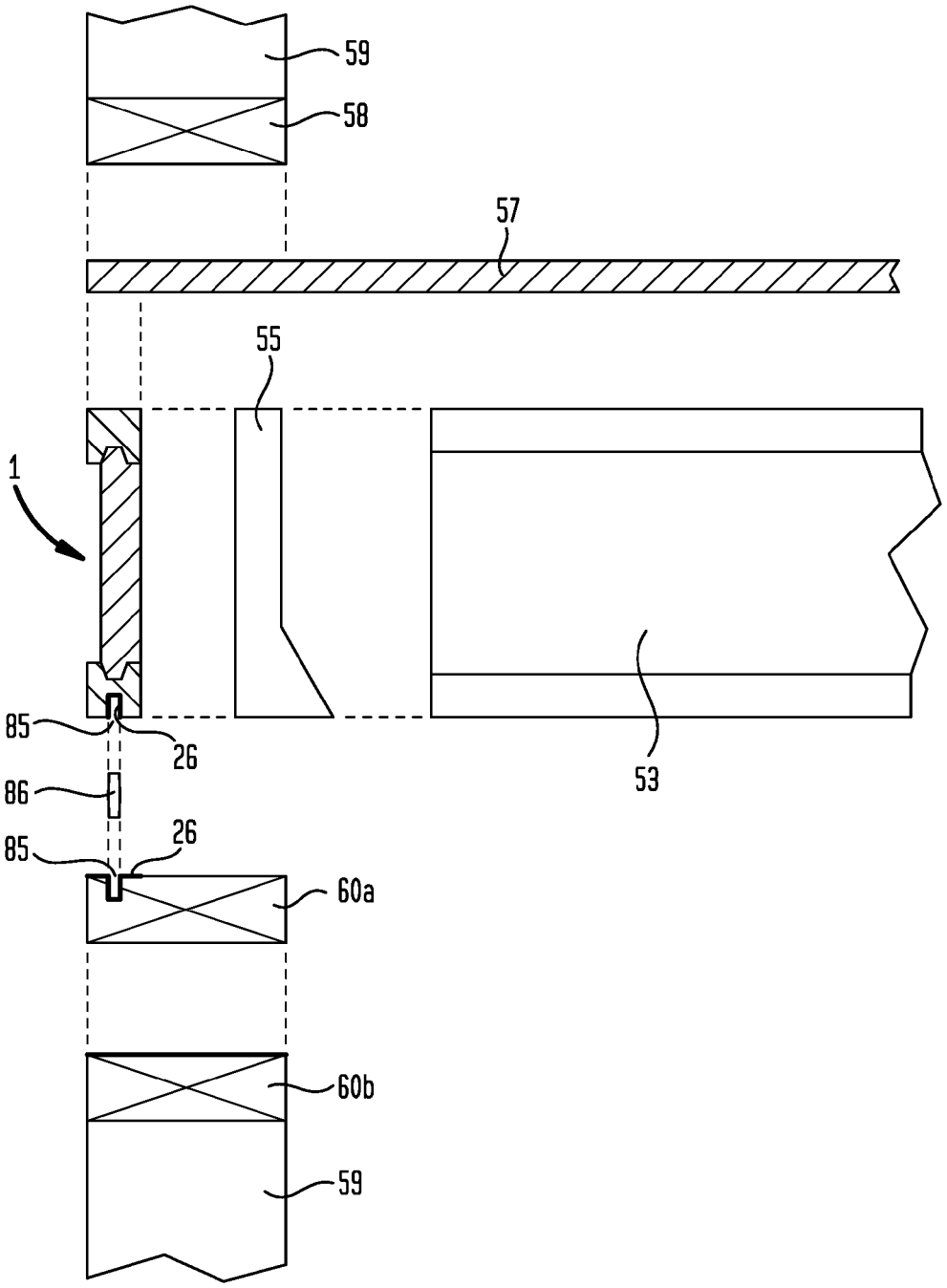
Figure 25A:
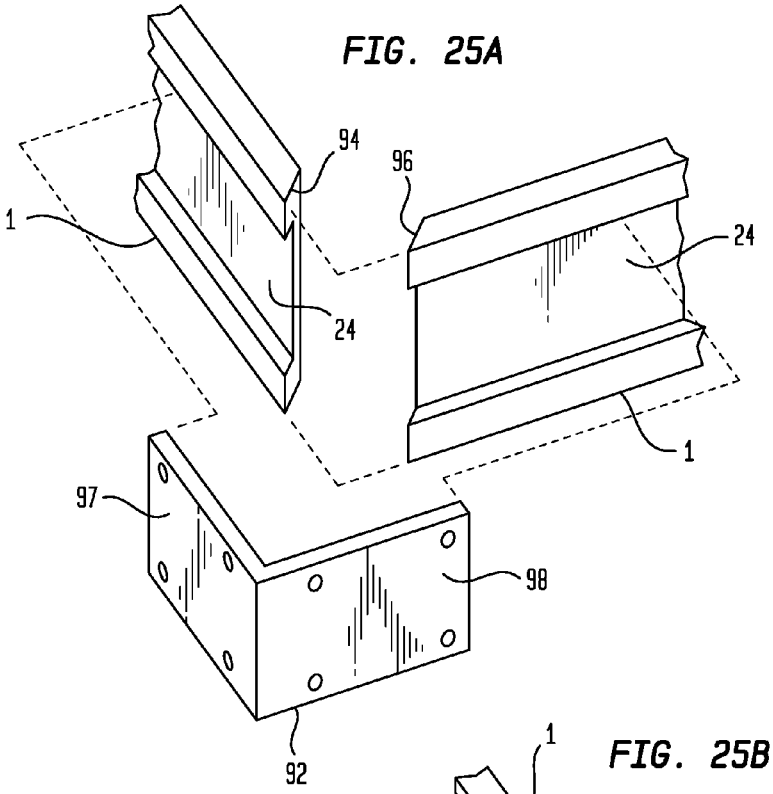
Figure 25B:
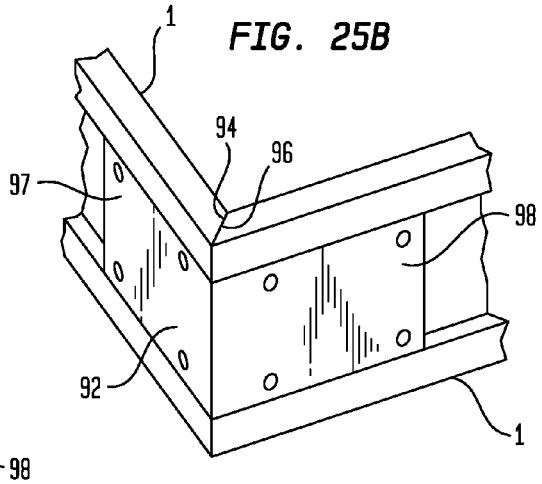
Figure 26:
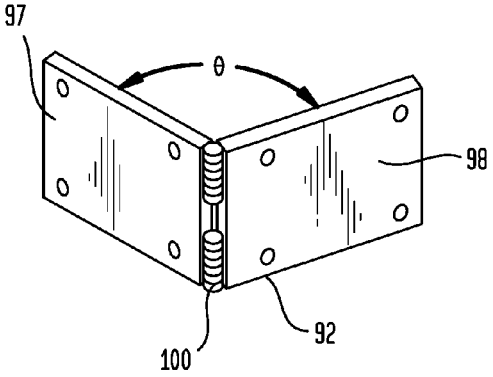

FIGS. 3-4 respectively illustrate, in simplified form, an exploded cross section of an alternative implementation of a structural engineered wood rim board for light frame construction according to the teachings herein, and the same alternative rim board with an alternative auxiliary structural member positioned within the cavity of the rim board;

FIG. 5 illustrates, in simplified form, a partial exploded cross sectional view of another alternative implementation of a structural engineered wood rim board for light frame construction showing different alternative auxiliary structural members which can be used in the cavity element to adjust the rim board's carrying capacity;

FIGS. 6A-6C respectively illustrate, in simplified form, cross sections of a portion of further variant implementations of a structural engineered wood rim board for light frame construction;

FIGS. 7A-7H illustrate, in simplified form, cross sections of portions of different further variant implementations of structural engineered wood rim boards for light frame construction along with end views of those respective rim boards;

FIGS. 8-9 illustrate, in simplified form, cross sections of an example implementation of structural engineered wood rim board for light frame construction with different alternative auxiliary structural members;

FIG. 10 illustrates, in simplified form, a cross section of a pair of example variant implementations of structural engineered wood rim boards for light frame construction according to the teachings herein coupled together via an alternative variant auxiliary structural member;

FIG. 11 illustrates, in simplified form, a perspective view of a light frame constructed multi-story building created using structural engineered wood rim boards as described herein;

FIGS. 12A-12D illustrate, in simplified form, partial cross sections taken at 12-12 of FIG. 11 to show the structural engineered wood rim boards according to the teachings herein as respectively used in an attic level (FIG. 12A), a second level (FIG. 12B), a first level (FIG. 12C), and a foundation level (FIG. 12D) of the building;

FIG. 13 illustrates, in simplified form, a perspective view of a portion of the foundation of the light frame construction building of FIG. 11 incorporating a variant structural engineered wood rim board according to the teachings herein;

FIG. 14 illustrates, in simplified form, a cross section of the portion of the foundation of FIG. 13 taken at 14-14;

FIG. 15 illustrates, in simplified form, a cross section of the portion of the foundation of FIG. 13 taken at 15-15 where the variant structural engineered wood rim board according to the teachings herein spans a foundation opening;

FIG. 16 illustrates, in simplified form, a cross section of a portion of a foundation of another light frame construction building using a variant structural engineered wood rim board according to the teachings herein and a variant auxiliary structural member so that both floor joists and exterior deck joists can be coupled to the rim board;

FIG. 17 illustrates, in simplified form, a perspective view of an upper portion of a floor of yet another light frame construction building constructed using advanced framing and using a variant structural engineered wood rim board according to the teachings herein to provide additional load support over two exterior wall openings;

FIG. 18 illustrates, in simplified form, an enlarged view of the cross section of FIG. 12B;

FIG. 19 illustrates, in simplified form, an enlarged view of a cross section of an upper portion of a floor of still another light frame construction building constructed using advanced framing and using a variant structural engineered wood rim board according to the teachings herein;

FIG. 20 illustrates, in simplified form, an enlarged view of a cross section of a corner of upper portion of a floor of a different light frame construction building and structural engineered wood rim boards according to the teachings herein with webs coupled to each other by an angled auxiliary structural member in a cantilevered configuration;

FIG. 21 illustrates, in simplified form, an enlarged perspective view of the portion of the light frame construction building incorporating the cross section of FIG. 12A;

FIG. 22 illustrates, in simplified form, a cross section of a portion of the light frame construction building of FIG. 21 taken at 22-22;

FIG. 23 illustrates, in simplified form, an exploded view of one variant structural engineered wood rim board according to the teachings herein as used on a foundation level;

FIG. 24 illustrates, in simplified form, an exploded view of one variant structural engineered wood rim board according to the teachings herein as used on a level other than a foundation or attic level;

FIG. 25A illustrates, in simplified form, an exploded view of an optional auxiliary structural corner support for use with structural engineered wood rim boards according to the teachings herein;

FIG. 25B illustrates the auxiliary structural corner support of FIG. 25A as assembled with one variant of two structural engineered wood rim boards according to the teachings herein; and FIG. 26 illustrates, in simplified form, an alternative optional auxiliary structural corner support for use with structural engineered wood rim boards according to the teachings herein that allows it to be used with different angle corners.

IV. DETAILED DESCRIPTION

For purposes of understanding, the following definitions are generally applicable to the description herein to the extent they expand upon the ordinary meaning of the terms and are not meant to limit or otherwise constrain the ordinary meaning in any way.

The term "framed support system" means a construct and a method of building using wood product members that are assembled into a frame that will form walls of a building and may support one or more floors and a roof. The frame is generally structural on the exterior of the building and, on the interior of the building, may or may not be structural. Without limiting the breadth of the foregoing, the term is intended to specifically include light frame construction generally and, more particularly, platform framing, which is the standard for construction of houses, apartments, small commercial buildings, and similar structures in the United States and Canada. Platform framed light construction typically uses vertical structural members, referred to as "studs" to create a stable vertical frame to which interior and exterior sheathing is attached to form walls. Horizontal floor and ceiling joists are used to create the platforms to which the walls attach in order to create a stable horizontal frame. Floor sheathing couples the floor joists to provide floors. Sloping rafters or truss frames are typically also used over the uppermost walls to provide a stable frame for attachment of roof sheathing that will support the external roof covering.

The terms "wood product" or "wood products" means building products configured for use in light frame construction that incorporate wood as a constituent component including, without limitation: natural logs, dimensional lumber, headers, beams, timbers, moldings, veneers, and engineered wood products such as strand board, strand lumber, laminated strand lumber, parallel strand lumber, glue laminated timber, oriented strand lumber, cross-laminated timber ("CLT"), ply board, laminated veneer lumber, plywood, medium density overlay plywood, high density overlay plywood, medium density overlay panel, high density overlay panel, chip board, particle board, wafer board, hard board, medium density fiberboard, high density fiberboard, steam cooked and pressure-molded board, advanced framing lumber ("AFL") and any other structural composite lumber (SCL) as well as composites made with wood, wood byproducts, or mixtures of wood fibers and adhesive or binding agents.

The term "wood substitute" means a substance which can formed, molded, fabricated or otherwise configured into a product and used in place of a wood product in creating a light frame construction building including, without limitation: agri-waste products, fiber cement, plastic, cardboard, paper resin laminates, or similar materials.

The term "adhesive" means any material useful for binding or adhering surfaces or particles in the manufacture of structural wood products or wood substitute products or for connecting such products together including, without limitation, animal glue, hide glue, casein-based glue, contact cement, formaldihyde-based glues, epoxy or resin-based glues, cyanoacrylate-based glues, construction adhesives, thermosetting adhesives including phenolic, polymeric methylene diphenyl diisocyanate, melamine, phenol resorcinol, resorcinol, polyurethane polymer, emulsion polymer isocyanate, polyurethane and emulsion copolymer, polyvinyl acetate, and thermoplastic resins, combinations thereof, and any other chemical, liquid or gel that can be used for purposes of adhering or bonding surfaces together.

The term "member body material" for the purposes of this disclosure means any wood-containing material which can be configured as a member body, structural rim board (1), flange or web as described herein, including, but not limited to, any wood product as defined herein.

The term "auxiliary structural member material" means any material which is physically configured as an auxiliary support member and has suitable load-transfer characteristics for the intended use as described herein. Examples of suitable auxiliary structural member materials, include, but are not intended to be limited to: wood products, wood substitutes, metals (particularly steel and aluminum), metal alloys, plastics, composites, or combinations thereof, the important feature being the load-transfer characteristics, not the material itself.

The term "load" means one or more forces applied or generated in a light frame construction building during its construction or when fully constructed and in use. Such loads can include, but are not limited to, dead loads (e.g. the weight of the materials that make up the structure) and live loads (e.g. occupants, furniture, appliances, etc. within the building), and loads applied by external forces (e.g. snow loads, wind loads, seismic loads, etc.) as well as combinations thereof.

Figure 1:
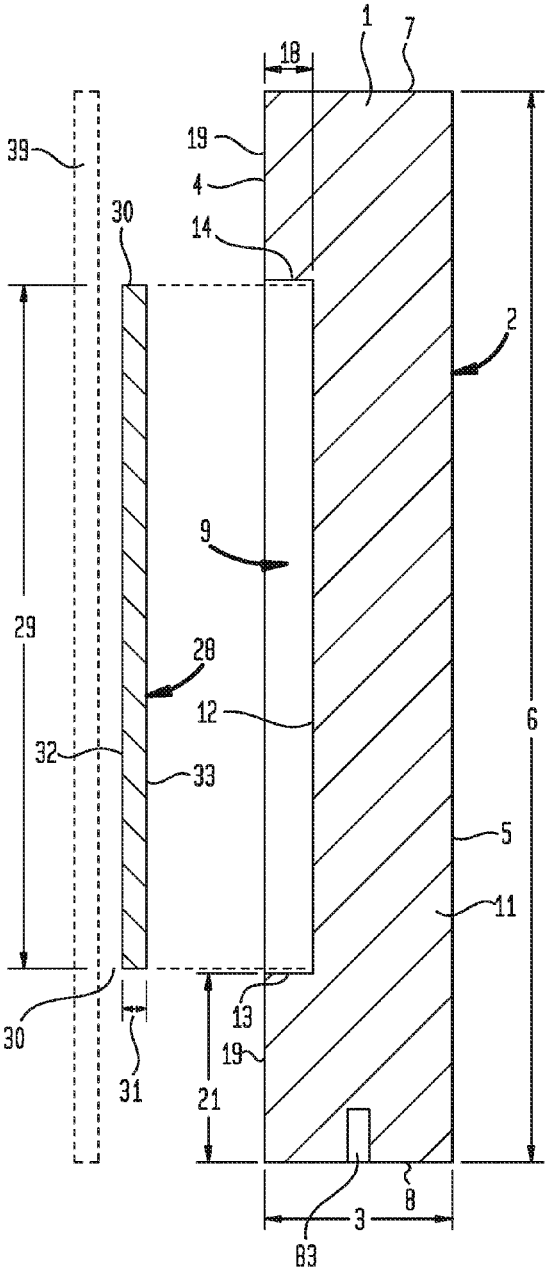
FIG. 1 illustrates, in simplified form, an exploded cross section of an example implementation of a structural engineered wood rim board for light frame construction according to the teachings herein.

With the above in mind, FIG. 1 illustrates, in simplified form, an exploded cross section of an example implementation of a structural engineered wood rim board (1) for light frame construction according to the teachings herein.

As shown in FIG. 1, the structural engineered rim board (1) includes a member body (2) (also referred to as "MB") having a member width (3) defined by face surfaces (4)(19) on one side and a second face (5) on the opposite side. The member body (2) also has a member height (6) defined by a pair of opposed edges (7)(8). The member body (2) has a length (not shown) that is perpendicular to the cross sectional plane of FIG. 1. The portion of the member body (2) between each face surface (4)(19) and the second face respectively form flanges of the structural engineered rim board (1). A cavity (9) is defined by opposed surfaces (13)(14) of the flanges and a recessed surface (12) of the structural rim board (1) that is offset from the face surfaces (4)(19) towards the second face (5). The cavity (9) extends longitudinally along the length of the structural rim board (1). In most implementations, the surfaces (12)(13)(14) defining the cavity (9) will generally each be substantially flat. The portion of the structural rim board (1) between the recessed surface (12) and the second face (5) forms a web of the structural rim board (1) and thereby defines a separation distance between the flanges.

The face surfaces (4)(19) are generally configured so that they lie in a common plane and have a sufficient area to allow for attachment of a facing layer (39), such as sheathing or other covering materials, thereto.

In general, the cavity height will be at least 50% of the overall height (6) of the structural rim board (1) and may be centered between the opposed edges (7)(8) or may be offset towards one or the other. For purposes of illustrative example only, the rim board of FIG. 1 has an overall height (6) of about 9½", a cavity height (17) of about 6½", and face surface (4)(19) heights of about 1½" each. As shown, the cavity depth (18) is about ½". Of course, these dimensions would differ depending upon the particular material used to create a particular rim board (1) as well as the intended load-carrying capacity in "as-manufactured" condition.

In addition, some implementations of the structural rim board (1) will include at least two, and likely more, joinery slots (83) cut into at least one of the edges (8), along its length. The joinery slots (83) are configured to typically accept standard joinery biscuits inserted therein for purposes of, for example, creating a structural connection of the structural rim board (1) with another building component like a top plate or sill plate having one or more corresponding joinery slots and/or for purposes of specific registration of the structural rim board (1) relative to one of those plates based upon the placement of the joinery slots (83) in each.

In general, the height (6), width (3) of the structural rim board (1) and the height (17) and depth (18) of the cavity (9) therein will generally be manufactured to pre-determined dimensions such that they can be sold in standard sizes and lengths, in most cases, compatible with manufactured, engineered lumber I-joists (e.g. in lengths from 12 to 60 feet long). In connection with the manufacture, for particular standard sized rim boards (1), specifications will provide the rim board (1) capacity to transfer vertical loads from the uppermost part of a structure to the structure below, as well as due to lateral forces such as wind and seismic forces between upper and lower structural assemblies. In addition to the above-mentioned load carrying capacities borne by structural rim boards (1) as described herein are their capacity to span different length openings based upon the member body material ("MBM") used in their construction. The methods for calculating load-carrying capacity of construction components like conventional rim boards and joists are well known, conventional and readily applied to rim boards as described herein, as is the provision of specifications and/or tables containing such capacities. With such specifications and/or tables, builders can determine the allowable unsupported span a particular length rim board can cover such that it will not fail as higher levels of the building are constructed or, thereafter when the building is finished, due to live loads applied thereafter.

For purposes of example only, and depending upon the particular intended application, the member width (3) can typically range from between about one inch to about five and one half inches. Typical example implementations of the rim boards described herein would likely be manufactured to have a member width (3) of between about 1" and about 5". Likewise, typical example implementations of the rim boards described herein would likely be manufactured to have a member height (6) of between about 8" to about 24". Due to the need for dimensional compatibility with other conventional structural components, typical example heights (6) for the rim boards described herein would likely be one of: 9½", 11⅞", 14", 16", 18", 20" and 24". In similar fashion, it is expected that structural engineered rim boards as described herein would be manufactured in some standard lengths ranging from about 12 feet to about 40 feet, so that they could be cut to desired length for the application on site.

Typically, conventional rim boards must be selected so as to be able to handle the maximum load that could be applied anywhere along their length. In the event that, after the fact, it is determined that the selected rim board size is insufficient for the loading in some particular area, for example, due to a change that adds a large opening in an exterior wall or a point load, additional structural changes must be made to compensate for that lack of load carrying capacity. This typically involves replacing, sistering or "doubling up" of the rim board in those areas, which often dramatically "over engineers" that area. The sistering or "doubling up" of the rim board or replacing it with a wider board in those areas, requires additional space to accommodate their widths and they take up additional space, typically on the building interior side, over the underlying sill plate or top plate, leaving insufficient room on the plate for supporting one or more joist(s).

Moreover, since the sill plate or top plate will likely have been installed prior to the change, it is likely not possible to replace the existing sill plate or top plate with a wider one, further potentially requiring use of a joist hanger to support the hoist(s) in lieu of using the plate for support.

Still further, sistering or "doubling up" of the rim board or replacing it with a wider board on an exterior side of the building in that area may be even less viable because it could interfere with the exterior sheathing or create problems with the placement or look of exterior details, such as siding, shingles and moulding.

Advantageously, as will be described in greater detail herein, with the rim boards constructed as described herein, the cavity (9) provides the ability to augment the load-carrying capability of the rim boards described herein, as needed, along their length, after placement, and without intentionally adversely affecting spacing on its interior or exterior sides. This can be accomplished through use of an auxiliary structural member (28) ("AM") that can be inserted into the cavity (9) of the rim board, after the rim board has already been attached to its underlying top plate or sill plate, and affixed to the web of the rim board such that the auxiliary structural member (28) will carry a portion of the load applied to the rim board in that area. Advantageously, as will be described in greater detail below, the auxiliary structural member (28) will typically have a width (29) that substantially corresponds to the height (17) of the cavity such that it needs to only be sized or selected (in length and depth) to provide that additional load-carrying capacity in the area where it is needed. Depending upon the particular implementation, the auxiliary structural member (28) can be placed in the cavity (9) such that at least one of its edges (30) will abut at least one of the opposed surfaces (13)(14) of the flanges.

Figure 2:
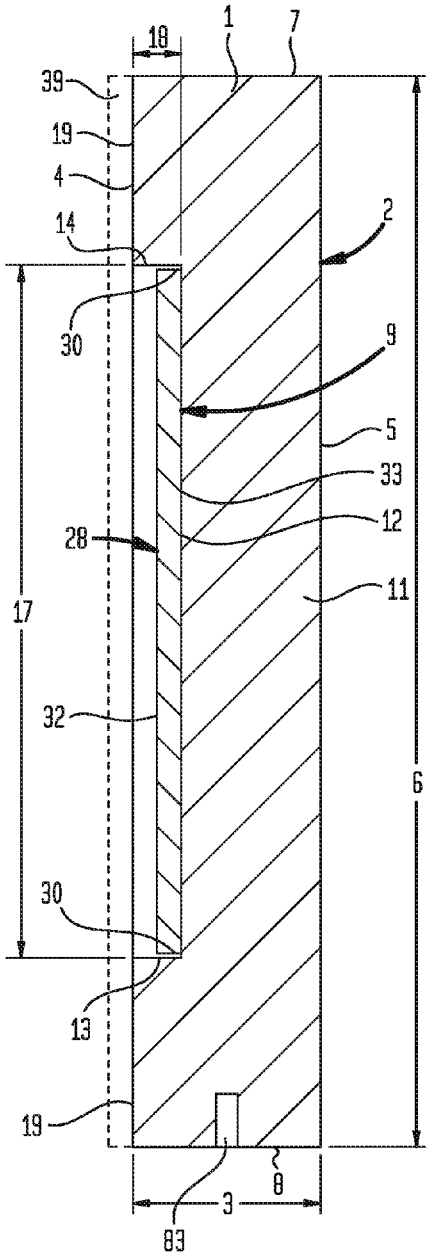
FIG. 2 illustrates, in simplified form, the cross section of the example structural engineered wood rim board of FIG. 1 with the auxiliary structural member positioned within the cavity of the rim board.

FIG. 2 illustrates, in simplified form, the cross section of the example structural engineered wood rim board of FIG. 1 with the auxiliary structural member (28) positioned within the cavity (9) of the structural rim board (1).

As shown, in FIGS. 1 and 2, the auxiliary structural member (28) has an auxiliary structural member width (31) defined by a first face (32) and a second face (33) of the auxiliary structural member. Depending upon the particular implementation, the thickness (31) of the auxiliary structural member can be substantially equal to the cavity depth (18), in which case, when inserted into the cavity (9) the first face (32) will be substantially flush with the surfaces (4)(19), or as shown in FIG. 2 it can be entirely recessed within the cavity (9). Advantageously, by using specific depth cavities (9) and specific thickness auxiliary structural members, multiple auxiliary structural members can be placed on top of each other (in a layered fashion) within a given cavity volume in a complete or partial overlapping fashion such that the load carrying capacity of the structural rim board (1) in particular areas can be augmented differently or incrementally increased on a location basis.

Again referring primarily to FIGS. 1 and 2, the structural member (1) can further optionally include a facing layer (39) which overlays the auxiliary structural member. Depending upon the particular implementation, the facing layer (39) can be discrete from the auxiliary structural member (28) As shown in FIGS. 1-2, or the facing layer (39) can be unitary with the auxiliary structural member (28). In some cases, the facing layer (39) can serve as a structure to which other components can be attached at a later time, for example, joist hangers for a deck.

FIGS. 3-4 respectively illustrate, in simplified form, an exploded cross section of an alternative implementation of a structural engineered wood rim board (1) for light frame construction according to the teachings herein, and the same alternative rim board (1) with an alternative variant auxiliary structural member (28) positioned within the cavity (9) of the structural rim board (1).

As shown in FIGS. 3-4, the this variant rim board (1) includes multiple bores or through holes (80) in the web that have been made, in this case, prior to usage, and are sized to each accommodate part of a mechanical fastener (38) inserted through it. Likewise, the variant auxiliary structural member (28) includes pre-made corresponding bores or through-holes (81) that are configured to also accept part of the mechanical fastener (38) so as to allow it to be specifically positioned and securely fastened, within the cavity (9), to the web of the structural rim board (1). Depending upon the particular implementation and thickness of the specific auxiliary structural member (28), the bores or through-holes (81) can be configured as straight bores or they can be countersunk so that a head of the mechanical fastener (38) will not protrude beyond the first face (32). Suitable examples of mechanical fasteners (38) include, for example, flat head bolts, carriage bolts, multi-jackbolts, hex bolts, or the like, that closely correspond to the diameter of the bore or through-hole (81) with which it will be used of sufficient length to allow the mechanical fastener (38) to pass through the auxiliary structural member (28) and the web of member body (2) and secured, in this case, with a nut (34) and washer (35). Alternatively, with some implementations, the auxiliary structural member (28) can have bores or through-holes (81) but the web will not have corresponding bores or through-holes, in which case other types of fasteners, like lag screws; can be used. In still other implementation variants, features can be formed in the auxiliary structural member (28), the web, or both to facilitate forming a better connection between them with one or more compatible adhesives.

Up to now, the structural rim board (1) has been illustrated as entirely made from a unitary beam of material. Thus, the manufacture of such a structural rim board (1) can be made in different ways, by, for example, forming a solid rectangular rim board and then removing material so as to form the cavity (9), by forming the rim board to the specific intended dimensions (including the cavity (9)) through a molding or other formation process, or, where the unitary beam is made by layering sheets or oriented fibers in a particular configuration, by incorporating the desired cross sectional shape into the layering process. Advantageously, the various ways of creating a structural engineered rim board for use as described herein allow, in some cases, for on-site creation of such rim boards by merely taking a conventional engineered rectangular rim board made of, for example, LVL or OSL and routing a cavity of suitable width and depth longitudinally on one side. For example, for an application that involves loadings such that one would normally use a 1¼" thick conventional rim board, one could use a 1¾" thick conventional rim board and create a ½" deep cavity along its length using a router or a series of passes of a dado blade to allow the newly-formed cavity (9) accommodate an auxiliary structural member (28).

FIG. 5 illustrates, in simplified form, a partial exploded cross sectional view of another alternative implementation of a structural engineered wood rim board for light frame construction showing different alternative auxiliary structural members which can be used in the cavity to adjust the rim board's load-carrying capacity.

As shown in FIG. 5, this variant rim board (1) is made up of three discrete components integrated together. Specifically, this rim board is made up of a first chord (22) forming one of the flanges, a second chord (23) forming the opposing flange, and a web (24) connecting the first chord (22) and second chord (23) and defining a separation distance between them. Note that this variant, does not contain the optional joinery slots. As can be seen in FIG. 5, the web (24) is offset such that a cavity (9) is formed on one side of the structural rim board (1) and the side of the rim board opposite the cavity (9) is a substantially flat surface. As shown in FIG. 5, each chord (22)(23) is connected to the web (24) using a tongue and groove type connection as is commonly used in conventional engineered wood I-joists. In addition, three different alternative variant example auxiliary structural members (28) are shown, respectively labeled AM-1, AM-2 and AM-3, that are each made of different materials, slightly vary in width (29*a*)(29*b*)(29*c*) and have different thicknesses (31*a*)(31*b*)(31*c*) so as to illustrate and exemplify the advantage that different auxiliary structural members (28) can be used with the same rim board (1) depending upon the particular augmentation required for the particular span.

Moreover, the use of two or more face-stacked or overlapping auxiliary structural members (28) advantageously can allow two abutting rim boards (1) to be spliced together.

With continuing reference to FIG. 5, and the alternative example alternative auxiliary structural members (28) having different dimensions and made of different example auxiliary structural member material ("AMM"). It is to be presumed, for purposes of illustrative example only, that the structural rim board (1) of FIG. 5 can be different variants made up of different alternative member body materials ("MBM"). Likewise, for purposes of illustration, certain exemplary alternative dimensions for the member body ("MB") (2) and the auxiliary structural members (28) ("AM") are to be presumed.

Under those constraints, Table 1 below specifies, in the first two rows, specific example MBMs for the chord and web of an example rim board (1) constructed as described herein, and, in the remaining 3 rows, different example variant AMs corresponding to the AMs of FIG. 5 (AM-1, AM-2, AM-3). Table 2 below describes specific member body material properties and auxiliary structural member material properties for the specific MBMs and AMs of Table 1. Tables 3A & 3B below collectively describe the structural member allowable load for the structural rim board (1) of FIG. 5 constructed in accordance with Table 1, along different unsupported spans, considered alone and when used in conjunction with each of the exemplary alternative auxiliary structural members, AM-1, AM-2, AM-3 of FIG. 5.

As noted above, in reading these Tables, it should be understood, each of the first chord (22) and second chord (23) will have a chord width (70) ("CW") and chord height (71)("CH"). For purposes of the example, set forth in Table 1, the chord width (70), the chord height (71) and the chord MBM are respectively specified as 1⅝" (CW), 1½" (CH) and the MBM is dimensional lumber, specifically, Douglas Fir Larch No. 2 Grade ("DFL-N #2"). Of course, in keeping with the numerous potential materials that could be used to construct the structural rim board (1) other suitable dimensional lumber that could be used as an MBM could include, for example, Hemlock Fir No. 2 Grade ("HemFir #2"). Indeed, any other material that is in accordance with the standards of the "National Design Specification for Wood Construction with Commentary and Supplements" and the "Supplement National Design Specification for Wood Construction", both published by the American Wood Council (2005) ("NDS"), the entirety of both of which are incorporated herein by reference as if fully contained herein, could likewise be used for the chords of this example.

Likewise, as to the web, the web (24) of the example rim board (1) has a web width (i.e. thickness) ("WW") (72) and a web height (73)("WH") and is made of a web MBM. For purposes of this example, the web MBM is Oriented Strand Board Type 1 ("OSB-Type 1") in accordance with the standards set forth in the "OSB Design Manual—Performance By Design", published by the Structural Board Association (2004) ("SBA Design Manual") and has a WW of 1⅛" and a WH of 6½" or 8⅞".

In FIG. 5, three example variants of the auxiliary structural member (28) are respectively identified as AM-1, AM-2 and AM-3 and each can be independently positioned in the cavity (9). Each of the auxiliary structural members (28) has an auxiliary structural member width (29)("AMW") and an auxiliary structural member thickness (31) ("AMT") and, for purposes of the tables below, in the case of AM-1, an AMM in accordance with the Plywood Design Specification, published by the American Plywood Association (now known as the Engineered Wood Association) ("APA Design Spec" (1997)) or, in the case of AM-2 and AM-3, in accordance with the Specification For Structural Steel Buildings (ANSI/AISC 360-05), published by the American Institute for Steel Construction (2005) ("AISC Design Manual"). For other AMMs, equivalent design guides can be used, for example, in the case of appropriate aluminum and aluminum alloys, the Aluminum Design Manual (2005), published by the by the Aluminum Association, Inc. In each of these instances, or for other AMMs, in actual usage, the newest design manual(s) available should be consulted.

Referring specifically to Table 1, as to representative illustrative example auxiliary structural member (28) AM-1, it has a width (cavity height-spanning breadth) of about 6½" or 8⅞" (depending upon and intended to closely correspond to the space between the flanges) and an AMT of about ½". The AMM of AM-1 is plywood grade "Plywood S3". The representative example auxiliary structural members (28) AM-2 and AM-3 both similarly have widths of about 6½" or 8⅞" (depending upon and intended to closely correspond to the space between the flanges) and are an AMM of A36 steel alloy ("A36 Steel"). As to thickness, AM-2 has a thickness of about ¼", whereas AM-3 has a thickness of about ½". Thus, it should be appreciated that, for a cavity (9) depth of about ½", one of AM-1 or AM-3 will fit in the cavity, whereas, with AM-2, a single unit could be used where lesser structural span load-carrying/load transfer augmentation is required, whereas in other areas, two AM-2s could be stacked together (i.e. in a depth direction) within that cavity (9) to provide greater load-carrying/load transfer capability. Moreover, with two AM-2s of equal length "L", the stacking could be offset such that they only partially overlap, for example, only half of each ("L"/2) overlap. In that case, the center overlapped portion would provide greater additional load-carrying/load transfer in that area, whereas the two end portions ("L"/4 each) would provide a lesser additional load-carrying/load transfer in those areas, although in each case, the load-carrying/load transfer capability would be higher than that of the structural rim board (1) alone.

TABLE 1

| Element | MBM Type | Thickness (inches) | Breadth (inches) | Reference Standard |
|---|---|---|---|---|
| Chord | DFL-N #2 | 1⅝ | 1½ | NDS 2005 |
| Web | OSB-Type 1 | 1⅛ | 6½ or 8⅞ (flange to flange) | SBA Design Manual |
| AM-1 | Plywood S-3 | ½ | 6½ or 8⅞ (flange to flange) | APA Design Spec |
| AM-2 | A36 steel | ¼ | 6¼ or 8⅝ (flange to flange) | AISC Design Manual |
| AM-3 | A36 steel | ½ | 6¼ or 8⅜ (flange to flange) | AISC Design Manual |

Table 2 contains various material property values of each MBM and AMM are set forth for each of the first and second cord (22)(23), the web (24) and each of auxiliary structural members AM-1, AM-2, AM-3 of FIG. 5 and Table 1. Certain of material property values were obtained using the NDS, SBA Design Manual, APA Design Spec and AISC Design Manual and others were obtained using the formulas provided in the NDS. Notes for certain values are indicated in the table and contained in the text immediately below the table.

TABLE 2

| Element | E (ksi) | Gv (ksi) | Fb (psi) | Fve (psi) | Fc⊢ (psi) | G (lateral) | Z (lbs) |
|---|---|---|---|---|---|---|---|
| Chord | 1,600 | — | 1,275(1) | 180 | 625 | 0.49 | — |
| | 1,300 | | | 150 | 405 | 0.42 | |
| Web | 650(2) | 142(2) | 1,200(2) | 720(2) | 128(2) | 0.5 | — |
| AM-1 | 1,200 | 55 | 1,200 | 120 | 210 | 0.42 | 118(3) |
| AM-2 | 29,000 | 11,200 | 21,560 | — | — | — | 290 |
| AM-3 | 29,000 | 11,200 | 21,560 | — | — | — | 290 |

(1)A size factor of 1.5 is included
(2)The design values are derived from Tables 5D-5F of the SBA Design Manual
(3)The values are determined by the formula in NDS Tables 3A-3B below use the information from Tables 1 & 2 to set forth the structural member allowable load in pounds by structural member span in inches for each of the variants of Table 1. Tables 3A-3B presume usage of the rim board (1) in a 2 story building with a basement. The rim board (1) is in lieu of a conventional rim board and bands the floor platforms with presumed loads of 690 pounds per liner foot (PLF) at the second floor, just below the ceiling joists and roof rafters, a load of 1210 PLF at the second floor platform (above the first floor), and a load of 1720 PLF at the first floor platform (above the foundation). The building is presumed as being 28 feet wide with all the floor and ceiling joists, as well as the roof rafters, running in the same 28 ft direction. The roof has an overhang of 2 ft and there is a center bearing beam structure starting at the foundation level and extending up through the attic. The rim board (1), by being perpendicular to the floor and ceiling rafters is, in effect, carrying all the structural loads from the exterior wall in towards the center bearing beam for a distance of 7 ft. The exterior wall weight is presumed at 100 PLF, the roof loads are applied vertically to the horizontal projections, a snow load of 115%, deflection is limited to L/240, first floor loading, second floor loading and roof loading are each presumed at 40 lbs/sq. ft. live load (LL)+20 lbs/sq. ft. dead load (DL) for a total of 60 lbs/sq. ft. total each. The attic loading is presumed at 20 lbs/sq. ft. (LL) and 10 lbs/sq. ft (DL) for a total of 30 lbs/sq. ft.

The "Option" line labeled "Rim Board" refers to the structural rim board (1) of FIG. 5, constructed according to the components set forth in Table 1 without any auxiliary structural member (28) secured within its cavity. The "Option" lines labeled AM-1, AM-2, AM-3 represent the structural rim board (1) of the first line with that particular AM from Tables 1-2 within the cavity (9) and rigidly secured to the web.

TABLE 3A

| Rim Board | | Structural Member Span (in inches) | | | | | | | |
|---|---|---|---|---|---|---|---|---|---|
| Height | Option | 24 | 30 | 36 | 42 | 48 | 54 | 60 | 66 |
| 9½" | Rim Board | 3794.9 | 2428.7 | 1686.6 | 1239.2 | 948.7 | 749.4 | 607.2 | 501.7 |
| | AM-1 | 4178.8 | 2674.5 | 1857.3 | 1364.5 | 1044.7 | 825.4 | 668.6 | 552.5 |
| | AM-2 | 7919.1 | 5068.2 | 3519.6 | 2585.8 | 1979.8 | 1575.9 | 1267.1 | 1047.0 |
| | AM-3 | 12043 | 7707.8 | 5352.6 | 3932.5 | 3010.8 | 2378.7 | 1926.7 | 1592.3 |
| 11⅞" | Rim Board | 5386.7 | 3447.5 | 2394.1 | 1758.9 | 1346.7 | 1063.9 | 861.9 | 712.2 |
| | AM-1 | 6168.8 | 3947.9 | 2742.6 | 2014.2 | 1542.1 | 1218.4 | 986.9 | 815.6 |
| | AM-2 | 14058 | 8996.7 | 6247.9 | 4590.3 | 3514.4 | 2776.8 | 2248.9 | 1858.6 |
| | AM-3 | 22729 | 14546 | 10102 | 7421.6 | 5682.2 | 4489.5 | 3637.1 | 3005.3 |

TABLE 3B

| Rim Board | | Structural Member Span (inches) | | | | | | | | |
|---|---|---|---|---|---|---|---|---|---|---|
| Height | Option | 72 | 78 | 84 | 90 | 96 | 108 | 120 | 132 | 144 |
| 9½" | Rim Board | 421.7 | 359.2 | 309.8 | 269.8 | 237.2 | 187.4 | 151.8 | 125.5 | 105.4 |
| | AM-1 | 464.3 | 395.6 | 341.1 | 297.1 | 261.2 | 206.4 | 167.2 | 138.1 | 116.1 |
| | AM-2 | 879.9 | 749.6 | 647.1 | 563.1 | 495.0 | 391.1 | 316.8 | 262.1 | 220.0 |
| | AM-3 | 1338.1 | 1140.1 | 987.3 | 856.3 | 752.7 | 594.7 | 481.7 | 397.9 | 334.5 |
| 11⅞ | Rim Board | 598.5 | 509.9 | 439.6 | 383.0 | 336.7 | 226.0 | 215.5 | 178.0 | 149.6 |
| | AM-1 | 685.4 | 584.0 | 503.4 | 438.6 | 385.5 | 304.6 | 246.7 | 203.9 | 171.3 |
| | AM-2 | 1561.8 | 1330.7 | 1147.8 | 999.5 | 878.6 | 674.2 | 562.3 | 464.7 | 390.5 |
| | AM-3 | 2525.3 | 2151.8 | 1855.6 | 1616.2 | 1420.8 | 1122.4 | 909.2 | 751.4 | 631.4 |

As evidenced by the values set forth in Tables 3A-3B, the load-carrying/load transfer capability of the structural rim board (1) can be changed and augmented by using various dimensional and MBM and AMM combinations to provide a correspondingly varied range of structural member total allowable loads. Accordingly, since the mere addition of an appropriate auxiliary structural member can significantly change the total allowable load, the same rim board can be used for the entire structure and, where particular spans or other loading concerns require higher load capacity, the rim board can be augmented with an appropriate AM for that area. This aspect is particularly advantageous when used in conjunction with advanced framing techniques because, normally, the rim board would be specified so as to handle the maximum expected load and unsupported span, even though most of the rest of the structure would not normally require such a rim board size absent that load or span (i.e. a lesser rim board would have been used). With rim boards as described herein, the lesser rim boards could be used for the entire structure and, in the area where a higher load capacity is required or a larger unsupported span an auxiliary structural member of appropriate AMM and dimensions could be added into the cavity (9) of the rim board so as to augment the total load capacity in and around that area.

A further advantage obtainable using rim boards (1) as described herein is that retrofit becomes easier. For example, consider a light frame construction building constructed using rim boards as described herein. At some point well after construction, the homeowner decides to have an exterior deck constructed which requires a larger unsupported span for the intended doorway than the present rim boards as described herein could span alone. Advantageously, by merely adding an appropriate auxiliary structural member into the exterior facing cavity of the rim board over the opening, the load carrying capability of the rim board can be increased such that the unsupported span for the doorway can easily be accommodated. This approach can significantly simplify the effort and thereby either reduce the cost or allow for design details (such as wider openings) that could not otherwise be accommodated as easily, if at all.

Likewise, during a remodel, the architect and homeowner may decide that a desired architectural detail of one or more exterior windows that extend all the way to the ceiling (i.e. it would not stop the typical 10"-12" from the ceiling. To accomplish this in conventional light frame construction, this would generally require removal of the top plate(s) over the area where the window(s) would be, significantly adversely affecting the structural load-carrying capability of the wall in that area (or as a whole). Moreover, if the conventional light frame construction building was more that a single story or even a single story building subject to high live loads, it might not be possible to even do so. In contrast, with rim boards constructed according to the description herein, the simple addition of an appropriate AM (or replacement of an existing AM for one that will provide an even higher total load capacity) of sufficient length to appropriately span the intended opening and transfer the load to either side of it, the top plate(s) could be cut because they would no longer be "structural" in that area. In contrast, significant additional demolition and construction effort (and consequently increased cost) would be required to accomplish the same effect.

FIGS. 6A-6C respectively illustrate, in simplified form, cross sections of a portion of further variant implementations of a structural engineered wood rim board for light frame construction.

Specifically, FIG. 6A illustrates, in simplified form, a cross section of a portion of one example variant rim board (1) using a tongue and groove type connection between the chord (22) and the web edge (25) using a amount of adhesive (26) at the junction (27) between the two. Note further that this example variant rim board (1) does not include the optional joinery slots in either chord (only one of which (22) is shown). FIG. 6B, illustrates, in simplified form, a cross section of a portion of an alternative example variant rim board (1), containing two rows of the optional joinery slots (83) in one chord (22) and in which the chord (22) is connected to the corresponding web edge (25) by one or more mechanical connectors (26*a*) inserted through the cord (23) into the web (24). Note here that, although this example variant shows the mechanical connector (26*a*) as a nail, the "mechanical connector" could comprise one or more of (alone or in combination): nails, brackets, braces, staples, screws, adhesives or other devices that form a physically connection between a chord (22)(23) and the web (24), the important aspect being the formation of a solid physical chord-to-web connection, not the means by which the connection is formed. FIG. 6C illustrates, in simplified form, a cross section of a portion of another alternative example variant rim board (1) having a single row of the optional joinery slots (83) and wherein the chord (22) is connected to the web (24) using a conventional finger joint.

Thus, it should be understood that, were a structural rim board (1) is created using separate discrete elements, any conventional means by which the chord and web can be connected so as to form a unitary rim board (1) can be used.

FIGS. 7A-7H illustrate, in simplified form, cross sections of portions of different further variant implementations of structural engineered wood rim boards for light frame construction constructed according to the teachings herein, along with end views of those respective rim boards. FIGS. 7A-7H thereby illustrate a few representative, non-limiting, examples of different configurations and orientations of the optional joinery slots (83) that can be used to create different variant configuration rim boards.

Figure 7A:
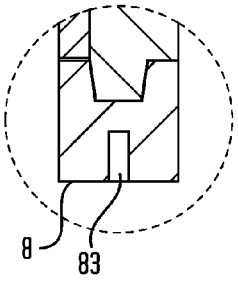

Specifically, FIG. 7A illustrates a cross section of a portion of one variant rim board, constructed as described herein, that has a row of at least two, and likely more (such as shown), linearly aligned joinery slots (83). FIG. 7B illustrates, in simplified form, an end view of the surface (8) of a flange of the rim board. Each slot (83) has a width (84) and a length (85) and a depth (not shown) so as to make it capable of accommodating an appropriate joinery biscuit. For example, depending upon the particular rim board (1) and intended use, different size joinery biscuits could be used. In general, wood joinery biscuits come in standard sizes such as: #H9, #FF, #0, #10, #20. It is expected that, in many cases, each slot would be sized to correspond to one of these standard joinery biscuit sizes, although custom sizes should be understood to be within the scope as well as would joinery biscuits made of other materials, the important aspect being the matching of the slot (83) and intended biscuit so that a strong joint can be formed between the rim board and a correspondingly slotted plate to which it will be attached, not the slot dimensions or particular biscuit material. Since the details of forming a biscuit slot and biscuit joinery in general are known, the techniques and equipment for forming joinery slots is known and understood, those details need not be reiterated herein.

Figure 7C:
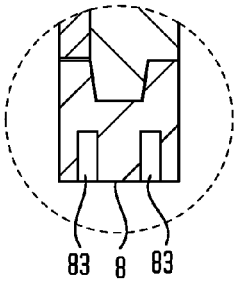
Figure 7E:
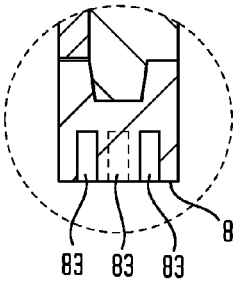
Figure 7G:
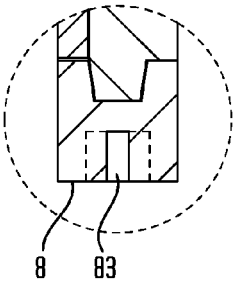
Figure 7B:
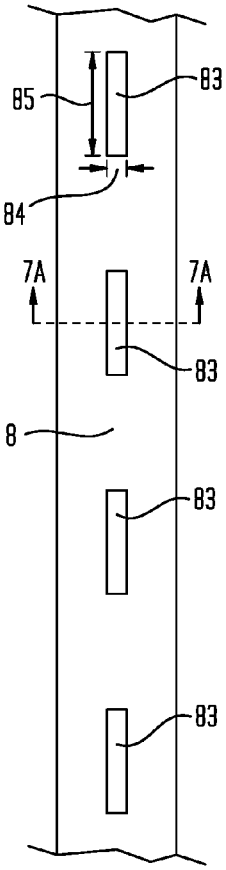
Figure 7D:
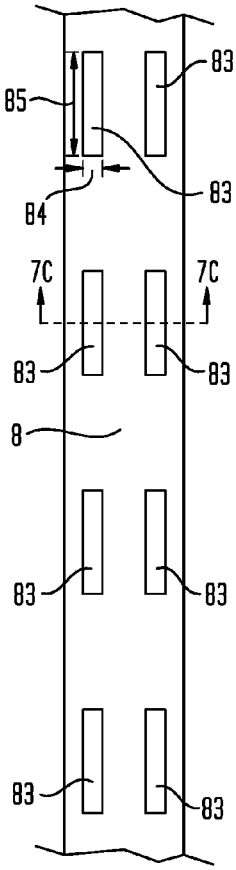

FIGS. 7C and 7D respectively illustrate, in simplified form, cross sectional and end views of a portion of another alternative rim board flange surface (8). As shown, this flange includes two rows of aligned joinery slots (83).

Figure 7F:
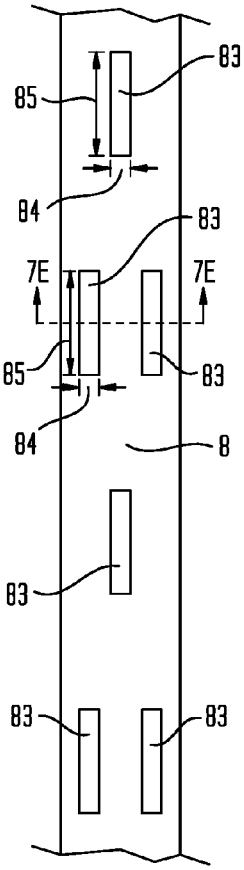

FIGS. 7E and 7F respectively illustrate, in simplified form, cross sectional and end views of a portion of yet another alternative rim board flange surface (8). As shown, this flange includes alternating single and paired joinery slots (83) with the single slots being linearly aligned with each other and the double joinery slots being aligned with each other but not aligned with the single slots.

At this point it is worth noting that the joinery slots (83), although shown as aligned in different fashions in FIGS. 7A-7F, this is not a requirement, it is an expedient; different variants can have different non-aligned joinery slots.

Figure 7H:
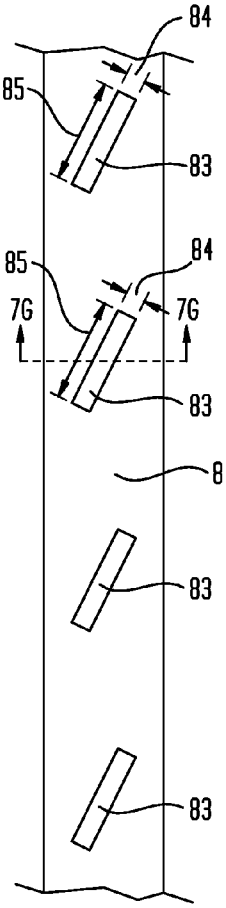

FIGS. 7G and 7H respectively illustrate, in simplified form, cross sectional and end views of a portion of another alternative rim board flange surface (8). As shown, this flange includes a single rows of joinery slots (83) that are each oriented at an angle offset form the longitudinal axis of the flange.

FIGS. 8-9 illustrate, in simplified form, cross sections of an example implementation of structural engineered wood rim board for light frame construction with different alternative auxiliary structural members.

Specifically, FIG. 8 illustrates, in simplified form, a variant unitary auxiliary structural member (28) having a size and dimensions such that it has a portion that extends into the cavity (9) and also beyond the rim board on the cavity-containing side. The auxiliary structural member (28) of FIG. 8 is dimensioned and positioned within the cavity (9) so that a portion will correspondingly engage the face (4) of the member body (2). As shown in this illustrative example, the auxiliary structural member (28) has a facing layer thickness (40) and a facing layer height (41) that can be similar to the thickness and height of the structural rim board (1), although the facing layer height (41) and facing layer thickness (40) can vary depending upon the application. As can be seen, by providing such an auxiliary structural member (28) not only can the load-carrying capability of the rim board be augmented, but it can provide a significant surface to allow for other members, for example, deck joist hangers, to be attached to it without affecting the rim board.

FIG. 9 similarly illustrates, in simplified form, another variant auxiliary structural member (28) that can be used with a structural engineered rim board (1) as described herein. As shown, the auxiliary structural member (28) includes a pair of terminal auxiliary structural member portions (43) within the cavity (9) but do not take up the whole cavity, allowing for some other element (42) (structural or not) to occupy that space. Depending upon the particular implementation, the space shown occupied by the element (42) could be vacant creating a passageway for things like, for example, cable television wires, fiber optic cable, computer cables, insulation, sensors, etc. as desired.

FIG. 10 illustrates, in simplified form, a cross section of a pair of example variant implementations of structural engineered wood rim boards for light frame construction according to the teachings herein coupled together via an alternative variant auxiliary structural member.

As shown in FIG. 10, in certain instances, it may be desirable to have a beam-like structure in a particular area of the light frame construction, for example, where stairs, a decorative column, or other detail may require a platform for support or where some element will hang from it. In such a case, an auxiliary structural member (28), of desired width, that is symmetrical in the intended vertical plane can be used such that a portion of a structural rim board (1) constructed as described herein of similar width can be coupled to the opposite side of the auxiliary structural member (28), in reverse-facing fashion, to create a deeper load bearing "beam" in the area with a deeper upper surface (8) and/or lower surface (7) that can provide the necessary structural support while also providing a flat surface 5 to which other materials can be affixed if desired.

Framed Support Systems & Methods Incorporating the Structural Rim Boards

Having described various aspects of different example variants of the structural engineered rim boards (1) and auxiliary structural members (28), can be utilized as components in a framed support system comprising conventional light frame construction or advanced framing techniques to great advantage. It should further be appreciated that those components can also be used with different panelized wall systems, including prefabricated panelized exterior walls and structural insulating panel ("SIP") systems, with similar or other alternative advantages resulting therefrom.

With this in mind, examples of applications involving structural engineered rim boards (1) and auxiliary structural members (28) as described herein will now be described with reference to FIGS. 11-26.

FIG. 11 illustrates, in simplified form, a perspective view of a light frame constructed multi-story building created using structural engineered wood rim boards as described herein.

FIGS. 12A-12D illustrate, in simplified form, partial cross sections, taken at 12-12 of FIG. 11, to show the structural engineered wood rim boards according to the teachings herein as respectively used in an attic level (FIG. 12A), a second level platform (FIG. 12B), a first level platform (FIG. 12C), and a foundation level platform (FIG. 12D) of the building of FIG. 11, and each of which include variants of the structural rim board (1) alone or having a variant auxiliary structural member (28) secured to the web of the structural rim board (1) within the cavity (9). Note that the configurations of FIG. 12B or 12C could each be applicable to any intermediate floor(s).

As shown in the portion of FIG. 12A, the structural rim board (1) is installed with the cavity (9) facing towards the exterior of the building with no auxiliary structural member located within the cavity. The structural rim board (1) sits on top of a top plate (60), which, in different implementations, can be a double top plate or a single top plate on top of a panel of a panelized wall system. For purposes of illustration a stud 59 that could be present in the case of conventional light frame construction and certain panelized walls. Above the structural rim board (1) on an interior side of the structural rim board (1) a supplemental joist support or blocking (75) is affixed to the structural rim board (1) such that, together, they support the attic floor joists (69) and attic rafters (68) to which the roof sheathing (67) is attached. Exterior sheathing (20) is affixed to the flanges of the outward-facing side of the structural rim board (1) to provide a base surface (61) for an exterior wall covering.

The FIG. 12B portion shows, in simplified form, a structural rim board (1) for the second level platform (i.e. the floor immediately below the attic level) of the building of FIG. 11. As shown, in FIG. 12B, the cavity (9) of the rim joist (1) contains an auxiliary structural member (28) in the area of the cross section, for example, member AM-2. The rim board (1) sits on top of a plate, as in FIG. 12A. Floor joists (53) (only one of which is shown) rest on a ledge formed by part of the top plate (60) and abut the side of the structural rim board (1) opposite the cavity. Screws (63) (only one of which is shown) are inserted, via the lower portion of the cavity (9), into and through the lower flange of the rim board and into the top plate(s)(60) of the wall beneath the structural rim board (1) on a periodic spacing along the length of the structural rim board (1) to further rigidly secure it to the top plate(s) (60). Floor sheathing (57) sits on top of the floor joists (53) and rim board (1) and, likewise, screws (63*a*) are used to rigidly secure the bottom, sole or sill plate (58) of the wall above the structural rim board (1) through the floor sheathing (57) to the structural rim board (1).

Figure 12C:
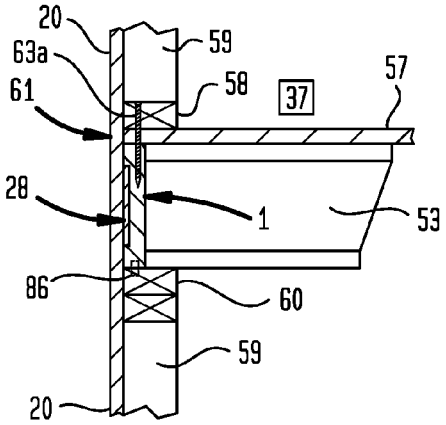

FIG. 12C shows, in simplified form, a structural rim board (1) for a portion of the first level platform (i.e. lower floor) of the building of FIG. 11 that is constructed similar to that of FIG. 12B except, for example, that the wall above is connected to the floor using conventional toe nailing (not shown). This variant rim board (1) includes joinery slots so that joinery biscuits (86) can be used to establish a specific location registration between the structural rim board (1) and a correspondingly slotted top plate (60) beneath it, and to help establish a rigid connection between the two through use of an adhesive (not shown) applied before the biscuits were inserted and two were joined. Likewise, the configuration of FIG. 12C does not use the screws (63) to secure the structural rim board (1) to the top plate (60) although, as will be described below, such screws could be used in addition to the joinery biscuits (86) and adhesive to further enhance the connection.

Figure 12D:
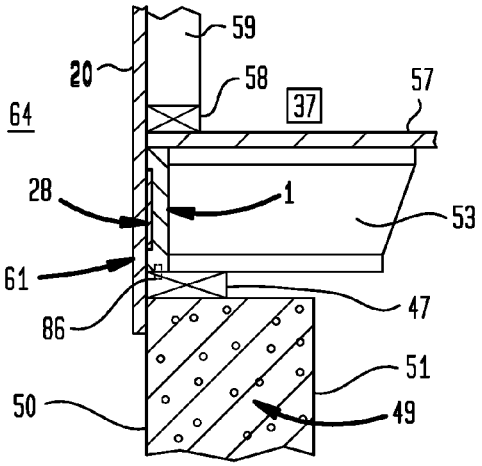

FIG. 12D shows, in simplified form, a structural rim board (1) for a portion of the foundation level platform. As shown in FIG. 12D, the structural rim board (1) rests on top of a sill plate (47) on the foundation (49) and is coupled to it via a connection using biscuit joinery slots in the structural rim board (1) and sill plate (47) and appropriate biscuits (86) and adhesive (not shown).

Thus, in each of FIGS. 12A-12D, the structural rim board (1) configurations are customized to appropriately transfer the loads (37), both vertical and lateral, live and dead, that would be present for this structure.

FIG. 13 illustrates, in simplified form, a perspective view of a portion of the foundation of the light frame construction building of FIG. 11 incorporating a variant structural engineered wood rim board according to the teachings herein.

Specifically, FIG. 13 shows, in perspective view, a foundation level of a light frame construction building incorporating a structural rim board (1) variant as described herein. As shown, the sill plate (47) is connected, in conventional manner to a top (48) of the foundation (49). The rim board (1) is oriented such that the cavity (9) faces in the direction of the exterior surface (50) of the foundation (49), and an auxiliary structural member (28) is present therein. The rim board (1) is joined to the sill plate (47) using a construction adhesive and the biscuit slots and biscuits (86) to provide proper registration, and/or enhance the connection, between the two.

The part of the sill plate (47) that extends inward beyond the structural rim board (1) provides a shelf (52) which can support one or more floor joists (53) with the ends of the floor joists abutting the interior-facing face (5) of the structural rim board (1). As also shown, in FIG. 12D and will be discussed in connection with FIG. 15, the cavity (9) of the rim joist (1) for a portion of this level contains an auxiliary structural member (28) which corresponds to AM-3.

FIG. 14 illustrates, in simplified form, a cross section of the portion of the foundation of FIG. 13, taken at 14-14. As shown, in the area of this section the structural rim board (1) is fully capable of transmitting the loads to the foundation (49), so no auxiliary structural member is present in this area. Of course, it will be understood that the foundation (49) can have one or more foundation openings (54) which the structural rim board (1) will span. In such a case, depending upon the particular span involved, the structural rim board (1) alone is incapable of adequately handling the load (37) that may be present (continually, periodically or intermittently).

Thus, in contrast to FIG. 14, FIG. 15 illustrates, in simplified form, a cross section of the portion of the foundation of FIG. 13, taken at 15-15, where the variant structural engineered wood rim board according to the teachings herein spans such a foundation opening (54). As a result, an auxiliary structural member (28), for example AM-3, that has a length sufficient to extend beyond either side of the opening (54) is inserted into the cavity (9) and secured to the web of the structural rim board (1) so as to sufficiently reinforce and assist the rim board (1) in bearing the total load (37) in that area and transfer it down, in this case to the foundation (49).

In addition, as a side note, in some cases, the spanning of an opening may mean that further reinforcement for the connection between the floor joists (53) and rim board (1) may be required. Advantageously, the presence of a flat face (5), on the side of the structural rim board (1) opposite the cavity (9), allows for the use of joist hangers (55)(or other connectors) to connect (or augment the connection) of the floor joists (53) to the structural rim board (1).

In this configuration, the auxiliary structural member (28) bears part of the load that the structural rim board (1) would otherwise experience over the opening and thereby augments the load-carrying capacity over the span.

FIG. 16 illustrates, in simplified form, a cross section of a portion of a foundation of another light frame construction building using a variant structural engineered wood rim board according to the teachings herein and a variant auxiliary structural member so that both floor joists and exterior deck joists can be coupled to the rim board.

As shown in FIG. 16, rim boards (1) constructed according to the teachings herein can be easily used in a retrofit/remodeling context, for example the addition of a deck. For example, as shown in FIG. 16, a foundation level platform of a light frame construction building was previously constructed using a structural rim board (1) as described herein. At some later point, it is desired to add a deck on the exterior of the building. As such, since such rim boards (1) as described herein were used, one need only cut through the exterior covering (78), for example, exterior siding, shingles, etc., the underlying exterior insulating board (74) (or other covering layer), and the sheathing (20) so as to expose the relevant part of the structural rim board (1) and its cavity (9) and allow for attachment of an appropriate auxiliary structural member (28), for example, configured as shown and described in connection with FIG. 8, to the structural rim board (1). In this manner decking joists (76)(or other horizontal supports) can abuttingly connect to the exterior-facing face (39) of the auxiliary structural member (28), for example using joist hangers (55), and then decking (88) can be conventionally attached to the decking joists (76)(or other horizontal supports) to form the deck structure.

As previously mentioned above, a further advantage to rim boards (1) constructed according to the teachings herein, is that they can be used to great advantage in connection with advance framing techniques or to allow for details not readily obtainable with ease using conventional rim boards.

FIG. 17 illustrates, in simplified form, a perspective view of an upper portion of a ground floor of yet another light frame construction building being constructed using advanced framing and using a variant structural engineered wood rim board according to the teachings herein to provide additional load support over two exterior wall openings (77*a*, 77*b*).

As shown in FIG. 17, a structural rim board (1), constructed according to one of the variants described herein and having a cavity depth of at least ½", must span a large opening (77*a*) (e.g. greater than 24") which will contain a window that will extend up to the ceiling, and an opening (77*b*) for a doorway exceeding 16" wide. As such, if only the opening (77*b*) for the doorway would be present, a single auxiliary structural member (28), for example of the AM-2 type described above and having a length that is longer than the doorway opening width, could be slid into the cavity over the doorway opening (77*b*) and affixed to the web of the structural rim board (1) to sufficiently enhance the load-carrying capability over the doorway opening (77*b*) and assist the structural rim board (1) in that area in transferring the load (37) in that area down to the king studs (59) to either side of that opening (77*b*). However, the nearby presence of the large opening (77*a*) for the window, and the need to remove the plates (60*a*, 60*b*) making up the double top plate of the wall to allow the window to extend to the ceiling means that significantly greater load carrying augmentation is required over that opening (77*a*). Advantageously, due to the nature of the rim boards (1) as described herein, two alternative ways of dealing with the situation are possible.

Presume that a single auxiliary structural member of the AM-2 type of a length sufficient to span beyond either side of the opening (77*b*) would be sufficient augmentation over the opening (77*b*) for the doorway to transfer the load portion over that opening (77*b*) to the king studs to either side of the opening (77*b*). Likewise presume that, the removal of the double top plate over the opening and the size of the opening would necessitate augmentation with a single auxiliary structural member (28) of the AM-3 type or a stack of two abutted auxiliary structural members (28) of the AM-2 type.

One potential way of dealing with the need to augment the load carrying capability of the structural rim board (1) would be to initially insert one auxiliary structural member (28-1) of the AM-2 type, that has a length exceeding the distance (10) between the king stud (59) on the left side of the window opening (77*a*) and the king stud (59) on the right side of the doorway opening (77*b*), into the cavity (9) such that its extreme ends extend over or beyond both of those king studs (59). Then, take a second auxiliary structural member (28-2) of the AM-2 type, that has a length that merely exceeds the width of the window opening (77*a*) (i.e. the distance between the king studs (59) to either side of it) and stack it within the cavity (9) on top of the first auxiliary structural member (28-1) such that it merely spans over the king studs (59) to either side of the window opening (77*a*). Once this is done, the auxiliary structural members (28-1, 28-2) are affixed to the web (24) of the structural rim board (1), for example, using pre-drilled and aligned bore holes (81), if present, or by making appropriate holes in the auxiliary structural members (28-1, 28-2).

An alternative, but similar way to augment the load carrying capability would be to insert an auxiliary structural member (28) of the AM-2 type that has a length merely exceeding the space between the king studs (59) to either side of the doorway opening (77*b*) into the cavity (9) such that the respective ends of that auxiliary structural member (28) are over the respective king studs (59) framing the doorway opening (77*b*) and affix it to the web of the structural rim board (1) using an appropriate method. This would provide the necessary augmentation over the doorway opening (77*b*).

As to the opening (77*a*) for the window, one could select an auxiliary structural member (28) of the AM-3 type that has a length exceeding the space between the king studs (59) to either side of that opening (77*a*) and insert it into the portion of the cavity (9) such that the respective ends of that auxiliary structural member (28) are over the respective king studs (59) to either side of that opening (77*a*) and affix it to the web of the structural rim board (1) using an appropriate method. This would provide the necessary augmentation over the window opening (77*a*).

Depending upon the particular implementation, with the first option, an alternative variant could be implemented by, for example, bonding or welding the two different auxiliary structural members (28) together prior to placement in suitable manner to potentially allow the hybridized auxiliary structural members (28) to be connected to the web of the structural rim board (1) with fewer or alternative connectors. Likewise, with the second option, if the two different auxiliary structural members (28) will be placed such that they will be end-butted, in the case of ones constructed of steel, they could be welded together at the end but so that both could be slid in and/or placed as a unit.

At this point it should be appreciated that, through use of rim boards (1) as described herein, and, where appropriate, suitable auxiliary structural members (28), in many cases, the use of structural headers, as well as the associated cripples and jamb/jack studs can be eliminated, saving time and material cost, without compromising the structural integrity of the exterior wall structure over an opening. In some cases, the came can be true if a structural rim board (1) as described herein used, during building construction, as part of the platform above a load-bearing interior wall. In this way, if it is desired to later remove a large portion of the wall to create an opening that extends right up to the ceiling, for example, this can easily be accomplished by inserting the appropriate auxiliary structural member in the cavity (9) of the structural rim board (1), and, again, jamb/jack studs, a structural header, or the use of a lally column can potentially be avoided.

At this point it should additionally be appreciated that a further advantage arising from the use of rim boards (1) containing cavities (9) configured to receive one or more auxiliary structural members (28) therein flows from the ability to shift an auxiliary structural member (28) within the cavity (9). This advantageously allows for, in the case of auxiliary structural members (28) with pre-drilled holes, the auxiliary structural member (28) to be affixed to the web of the structural rim board (1) with reduced concern for the possibility of hitting a joist or joist-hanging hardware on the opposite side. This advantage is achievable because, if this is a possibility, the auxiliary structural member (28) can be shifted slightly in one direction or the other such that the through hole (80) or location in the web (24) where the auxiliary structural member (28) will be secured to the web (24) will not interfere with the joist or joist-hanging hardware on the opposite side.

FIG. 18 illustrates, in simplified form, an enlarged view of the cross section of FIG. 12B in order to show the placement of adhesive (26): i) between the lower edge of the structural rim board (1) and the boards (60*a*, 60*b*) making up the double top plate, ii) between the boards (60*a*, 60*b*) making up the double top plate, iii) between the upper edge of the structural rim board (1) and the floor sheathing (57), and iv) between the bottom, sole or sill plate (58) of the upper wall and the floor sheathing (57), so as to help form (in conjunction with the screws (63, 63*a*)) rigid connections among them. Likewise, this enlarged view provides a better view of the screws connecting the upper and lower walls to the structural rim board (1).

At this point it is worth noting that the screw (63) of this configuration is generally intended to be inserted at an angle of between about 18° and 30° from the vertical, and typically on the order of about 20° to 25° from the vertical, and, ideally, at an angle of about 22° from the vertical, and should have a length such that, when fully installed, it reaches at least ¾ of the way into the plate in the case of a single plate and at least about halfway into the lower plate of a double plate configuration. Moreover, ideally, the screws (63, 63*a*) should be of the type commonly referred to as non-splitting screws. Alternatively, the screws (63, 63*a*) could be nails, for example, shank nails, provided the nails will not split the flange. However, nails will not necessarily hold to the same extent as screws.

Another advantage arising from this type of configuration is that the rigid connection among the plate (58) of the upper wall, the upper flange of the structural rim board (1) and the floor sheathing (57) between them, has the effect of creating a virtual increase in the size and load capacity of the upper flange of the structural rim board (1). The same is true for the rigid connection formed among the lower flange of the structural rim board (1) and the double top plate components (60*a*, 60*b*), it results in a virtual increase in the size and load capacity of the lower flange of the structural rim board (1). In other words, this type of connection can create the equivalent of a significantly larger and greater load-bearing capacity rim board.

FIG. 19 illustrates, in simplified form, an enlarged view of a cross section of an upper portion of a floor of still another light frame construction building constructed using advanced framing and using a variant structural engineered wood rim board according to the teachings herein.

As shown in FIG. 19, the structural rim board (1) of this figure includes angled joinery slots such as shown in FIGS. 7G-7H and the upper plate (60*a*) of the double top plate contains corresponding slots therein. A joinery biscuit (86) between the two helps form a rigid connection between the two while establishing a positional registration between them as well. As additionally shown, an auxiliary structural member (28) configured as shown in FIG. 8 extends beyond the sheathing (20) and exterior insulating board (74)(or other covering layer) such that it is in direct communication with an exterior finish layer (78) such as stucco, clap board, siding or the like. This configuration, therefore shows the an alternative predecessor to that described in connection with FIG. 16, one which pre-supposes the possibility of a deck being added, such that removal of only the exterior finish layer (78) is needed to provide access to the auxiliary structural member (28).

FIG. 20 illustrates, in simplified form, an enlarged view of a cross section of a corner of upper portion of a floor of a different light frame construction building and structural engineered wood rim boards according to the teachings herein with webs coupled to each other by an angled auxiliary structural member in a cantilevered configuration.

As shown in FIG. 20, a further advantage of using a structural rim board (1) as described herein is it allows for easier creation of a cantilevered overhang (90) because the structural rim board (1) need not be unnecessarily configured along its entire length with a load handling capacity appropriate for the overhang. Rather, a lesser structural rim board (1) can be used and an appropriate auxiliary structural member (28) can be used in the vicinity of the cantilevered overhang to accommodate the loading in that area. In addition, as shown, the auxiliary structural member (28) has an angled configuration. Advantageously, this configuration can also help prevent deflection of the web due to point loading. The details of this configuration and its benefits in some applications will be described below in connection with FIGS. 25A, 25B & 26.

Likewise, in connection with larger overhangs, in some cases, structural rim boards (1) as described herein can be used in place of joists such that, by inserting and affixing appropriate auxiliary structural members (28) to the within the overhang and an appropriate distance inboard of the overhang, problems like joist overturning can be avoided.

FIG. 21 illustrates, in simplified form, an enlarged perspective view of the portion of the light frame construction building employing advanced framing techniques and incorporating the cross section of FIG. 12A. As shown in FIG. 21, the use of a structural rim board (1) and an auxiliary structural member (28) that has a length (36) extending it beyond the king studs (59) on either side of the opening (77*c*), renders the header (89) and associated cripple (59) non-structural, and eliminates the need for jamb/jack studs underneath the sill (91) of the opening (77*c*). In this variant, the auxiliary structural member (28) is a truss (82), for example one similar to the truss disclosed in U.S. Pat. No. 7,765,771 (the entirety of which is incorporated herein by reference as if fully set forth herein) except that the flange width would generally correspond to the depth of the cavity (9) and the truss height would generally correspond to the web height (i.e. the width of the cavity (9)) so that it could be inserted into the cavity (9) and joined to the web of the structural rim board (1), for example, as described herein.

FIG. 22 illustrates, in simplified form, a cross section of the portion of the light frame construction building of FIG. 21 taken at 22-22 to more clearly show the construction in greater detail. Note that, as shown, the lower flange of the structural rim board (1) contains joinery slots of the configuration of FIGS. 7C-7D. In corresponding fashion, top plate (60*a*) contains similar joinery slots, and the two are joined together with the aid of joinery biscuits (86) and adhesive (26) between the various components.

FIG. 23 illustrates, in simplified form, an exploded view of the structural engineered wood rim board (1) as used on a foundation level such as shown in FIG. 15 (although the auxiliary structural member (28) is not shown. From this exploded view, the locations for placement of the adhesive (26) can be seen more clearly, as can the joinery slots (85) in the structural rim board (1) and the sill plate (47).

FIG. 24 illustrates, in simplified form, an exploded view of a structural engineered wood rim board (1), as used on a level other than a foundation or attic level, that is similar to the one shown in FIG. 18 except that it includes a joist hanger (55) because it is a section taken over an opening. This section too, better shows the placement of the adhesive (26), the joinery slots (85) in the structural rim board (1) and the top plate (60*a*).

As briefly alluded to in connection with FIG. 20, the auxiliary structural members described herein need not be planar, they can be angled to advantageously obtain similar benefits in and around corner areas. In such a case, these optional auxiliary structural members form a subset of those members called herein an auxiliary structural corner support (92).

FIG. 25A illustrates, in simplified form, an exploded view of an optional auxiliary structural corner support (92) for use with a pair of structural engineered wood rim boards (1) according to the teachings herein on an exterior side of a corner. As shown, the ends (94, 96) of the structural engineered wood rim boards (1) are angle cut (also called miter cut) in a mating arrangement such that, when the cut ends (94, 96) are brought together, they form a right angle corner. The auxiliary structural corner support (92) of this configuration is made up of two arms (97, 98) that are each, individually, auxiliary structural members (28) as described herein. Thus, when the arms (97, 98) are affixed to the respective webs 24 of the structural engineered wood rim boards (1), they can provide the additional load carrying capability discussed above and, moreover, can prevent spreading of the rim boards (1) when they directly support a hip rafter or valley rafter of a roof.

It is to be understood that the angle between the arms (97, 98) need not be limited to a right angle. Any fixed angle that can be formed between the two arms (97, 98), by for example, bending or welding, can be used with this variant. It is to also be understood that, in lieu of using an angled or miter cut, the web and/or flanges of the structural engineered wood rim board (1) can be notched or cut down such that the webs form the proper corner with no gap in between.

FIG. 25B illustrates the auxiliary structural corner support (92) of FIG. 25A as assembled.

FIG. 26 illustrates, in simplified form, an alternative variant of the optional auxiliary structural corner support (92) for use with structural engineered wood rim boards (1) according to the teachings herein that allows it to be used in the cavity (9) with many different angles within an angular range of "θ" corresponding to the angle between the structural rim boards (1). As shown, with this variant of the optional auxiliary structural corner support (92) the arms (97, 98) are joined to each other by a suitably strong for the intended application hinge (100) structure. Thus, with this variant of the optional auxiliary structural corner support (92), by angle cutting or mitering the ends (94, 96) of the structural engineered wood rim boards (1) at different angles, the hinge (100) of this variant auxiliary structural corner support (92) can be used to match those angles whether they are less than, or more likely more than, 90° (i.e. a right angle). This allows for the structural engineered wood rim boards (1) to be used in connection with bay and/or bow windows and walls that intersect at angles other than 90° relative to each other.

It should be understood that the foregoing description (including the figures) only includes some illustrative embodiments. For the convenience of the reader, the illustrative embodiments of the above description is intended as merely a representative sample of all possible embodiments, a sample that teaches the principles of the invention. The description has not attempted to exhaustively enumerate all possible variations or combinable permutations or combinations. That alternate embodiments may not have been presented for a specific portion of any variant, or that further non-described alternate embodiments may be available for a portion of a variant, is not to be considered a disclaimer (intentional or unintentional) of those alternate embodiments. One of ordinary skill will appreciate that many of those non-described embodiments incorporate the same principles of the claimed invention and that others are equivalent thereto. Likewise, it is to be understood that certain variants may be mutually exclusive in that they cannot be simultaneously present in a single embodiment or portion thereof. That such mutual exclusivity may exist should not be considered a disclaimer of any such variants.

What is claimed is:

1. A structural engineered wood rim board corner system for light frame construction comprising:

A) two structural engineered wood rim boards, wherein i) each of the two structural engineered wood rim boards is made up of a pair of flanges connected by a web so as to form a recessed cavity in-between the flanges on one side and on an opposite side of the structural engineered wood rim boards the pair of flanges and web form a surface that is substantially flat, ii) the width of the web of each of the two structural engineered wood rim boards is at least 50% of the overall width of the structural engineered wood rim boards, iii) the two engineered wood rim boards are abutted relative to each other at corresponding ends so as to form an angled intersection, with the cavity being on an exterior angle portion of the intersection; and B) an auxiliary corner support made up of two arms oriented at an angle relative to each other corresponding to the angled intersection, wherein i) the auxiliary corner support has a width less than the width of the web and between 6¼" and 8⅞", ii) one of the two arms of the auxiliary corner support is within one of the cavities and the other of the two arms is within the other cavity, and iii) each of the two arms abut and are affixed to their corresponding webs, so as to concurrently (1) maintain the two engineered wood rim boards at an orientation relative to each other corresponding to the angle, and (2) assist the web in transferring a load applied to the upper flanges near the corner to a part of the structure below the lower flanges while resisting spreading of the corresponding ends of the two engineered wood rim boards at the angled intersection.

2. The structural engineered wood rim board corner system of claim 1, wherein the auxiliary corner support is metal.

3. The structural engineered wood rim board corner system of claim 2 wherein the auxiliary corner support further comprises:

a hinge connection interconnecting the two arms.

4. The structural engineered wood rim board corner system of claim 2 wherein the angle of the auxiliary corner support was formed by bending.

5. The structural engineered wood rim board corner system of claim 2 wherein the angle of the auxiliary corner support is maintained at a fixed angle by a weld.

6. The structural engineered wood rim board corner system of claim 2 wherein the angled intersection of the two engineered wood rim boards is formed as a mitered corner joint.

7. The structural engineered wood rim board corner system of claim 2 further comprising:

at least one of a hip rafter or a valley rafter positioned over the auxiliary corner support.

8. The structural engineered wood rim board corner system of claim 1, wherein at least one flange of the pair of flanges making up each of the two structural engineered wood rim boards is made of one of:

dimensional lumber, laminated veneer lumber ("LVL"), parallel strand lumber ("PSL"), laminated strand lumber ("LSL"), oriented strand lumber ("OSL"), oriented strand board ("OSB"), glue laminated timber ("glue-lam"), a composite wood product, advance framing lumber ("AFL") or cross laminated timber ("CLT").

9. A method performed as part of light frame construction comprising:

A) abutting two structural engineered wood rim boards relative to each other at corresponding ends at an angle of intersection so as to form a corner for the light frame construction, wherein i) each of the two structural engineered wood rim boards is made up of a pair of flanges connected by a web so as to form a recessed cavity in-between the flanges on one side and, on an opposite side of the structural engineered wood rim boards, ii) the pair of flanges and web form a surface that is substantially flat, iii) the width of the web of each of the two structural engineered wood rim boards is at least 50% of the overall width of the structural engineered wood rim boards, and iv) the recessed cavity is on an exterior angle portion of the intersection;

B) attaching an auxiliary corner support, having two arms, to the two structural engineered wood rim boards, wherein i) the auxiliary corner support has a width less than the width of the web and greater than 6¼", ii) one of the two arms of the auxiliary corner support is within one of the cavities and the other of the two arms of the auxiliary corner support is within the other cavity, and iii) each of the two arms abut and are affixed to their corresponding webs;

C) in combination, the two structural engineered wood rim boards and the auxiliary corner support i) maintaining the two engineered wood rim boards at an orientation relative to each other corresponding to the angle, ii) assisting the respective webs in transferring a load, applied to at least an upper flange of at least one of the two structural engineered wood rim boards near the corner, to a part of the light frame construction below the combination, and iii) resisting spreading of the corresponding ends of the two engineered wood rim boards at the corner.

10. The method of claim 9, wherein the abutting comprises:

bringing the two structural engineered wood rim boards together such that the angle of intersection is a right angle.

11. The method of claim 9, wherein the abutting comprises:

bringing the two structural engineered wood rim boards together such that the angle of intersection is other than a right angle.

12. The method of claim 11, wherein the auxiliary corner support includes a hinge between the two arms, and wherein, prior to the attaching the auxiliary corner support the method further comprises:

adjusting an angle between the two arms to correspond to the angle of intersection of the corner.

13. The method of claim 9, wherein the auxiliary corner support includes a hinge between the two arms, and wherein, prior to the attaching the auxiliary corner support the method further comprises:

adjusting an angle between the two arms to correspond to the angle of intersection of the corner.

14. The method of claim 9, wherein the auxiliary corner support is a metal, the method further comprising:

forming the auxiliary corner support by bending the metal.

15. The method of claim 9, wherein the auxiliary corner support is a metal, the method further comprising:

forming the auxiliary corner support by welding the metal.

* * * * *